US007482153B2

(12) United States Patent
Okada et al.

(10) Patent No.: US 7,482,153 B2
(45) Date of Patent: Jan. 27, 2009

(54) NUCLEIC ACID DETECTION CASSETTE AND NUCLEIC ACID DETECTION DEVICE

(75) Inventors: Jun Okada, Tokyo (JP); Sadato Hongo, Yokohama (JP); Kenji Ooki, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 151 days.

(21) Appl. No.: 11/384,506

(22) Filed: Mar. 21, 2006

(65) Prior Publication Data

US 2006/0216812 A1 Sep. 28, 2006

(51) Int. Cl.
*C12M 3/00* (2006.01)

(52) U.S. Cl. ..... 435/287.2; 435/287.5

(58) Field of Classification Search ..... 435/287.2, 435/287.5

See application file for complete search history.

(56) References Cited

U.S. PATENT DOCUMENTS

| | | | | |
|---|---|---|---|---|
| 6,605,454 | B2 | 8/2003 | Barenburg et al. | |
| 6,830,936 | B2 | 12/2004 | Anderson et al. | |
| 2004/0197810 | A1 * | 10/2004 | Takenaka et al. | 435/6 |
| 2005/0153430 | A1 * | 7/2005 | Ohtaka | 435/287.2 |
| 2006/0216812 | A1 | 9/2006 | Okada et al. | |

FOREIGN PATENT DOCUMENTS

| | | |
|---|---|---|
| JP | 2536945 | 7/1996 |

OTHER PUBLICATIONS

U.S. Appl. No. 11/848,623, filed Aug. 31, 2007, Hongo, et al.

* cited by examiner

*Primary Examiner*—Walter D Griffin
*Assistant Examiner*—Lydia Edwards
(74) *Attorney, Agent, or Firm*—Oblon, Spivak, McClelland, Maier & Neustadt, P.C.

(57) ABSTRACT

A nucleic acid detection cassette includes a cassette body, a nucleic acid detection region disposed in the cassette body, a first channel disposed in the cassette body, a second channel disposed in the cassette body. The nucleic acid detection region, in which a nucleic acid probe is immobilized, has a reagent inflow port, to which the first channel is connected, and a reagent outflow port, to which the second channel is connected. The nucleic acid detection cassette further includes a reagent injection portion which injects a reagent into the first channel, and a nucleic acid pretreatment region which is disposed in the first channel and which performs pretreatment for the detection of a nucleic acid. The first channel, the second channel, the nucleic acid detection region, the nucleic acid pretreatment region, and the reagent injection portion are sealed.

13 Claims, 15 Drawing Sheets

NUCLEIC ACID DETECTION CASSETTE AND NUCLEIC ACID DETECTION DEVICE

BACKGROUND OF THE INVENTION

1. Field of the Invention

The present invention relates to a nucleic acid detection cassette which completely automatically performs the detection of a nucleic acid and its pretreatment step for a purpose of detecting a target nucleic acid, and a nucleic acid detection device by use of this nucleic acid detection cassette.

2. Description of the Related Art

In recent years, with development of genetic engineering, it becomes possible to diagnose or prevent a disease by a gene in a medical field. This is called genetic diagnosis. A human genetic defect or change as a cause for the disease can be detected to diagnose or predict the disease before it is developed or in a remarkably initial stage of the disease. With deciphering of a human genome, an investigation on a genotype and a plague has been proceeded, and diagnoses (tailor-made diagnoses) have been actualized in accordance with individuals' genotypes. Therefore, it is very important to easily detect the gene and determine the genotype.

Heretofore, to detect a nucleic acid, there have been used various devices such as a nucleic acid extraction device, a nucleic acid amplification device, a hybridization device, a nucleic acid detection device, and a data analysis device. Moreover, manpower has been required in preparation of samples and movement of the samples between the devices which are operations other than operations realized by these devices.

A PCR method is mainly used in amplifying the nucleic acid. This method has a very high amplification factor. Therefore, there is a problem that when even a remarkably slight amount of another nucleic acid is mixed into the sample before amplified, even the nucleic acid is amplified into a large amount, and erroneous detection is caused. It is known that nucleic acid molecules are stabilized even in dried states, the molecules are adsorbed by various substances, and the molecules sometimes float in the air. Therefore, to prevent the erroneous detection, a severe administrative system is required in which the amplified sample is not brought into a place where the nucleic acid is extracted.

In recent years, there is developed a device which automatically performs steps of hybridization reaction to data analysis. Recently, there is also developed a fully automatic nucleic acid detection device which automatically performs the extraction of the nucleic acid to the data analysis. However, in the existing fully automatic nucleic acid detection device, any secure measure is not taken against mixture of a nucleic acid molecule which is not an object of the detection. Moreover, since the device is often large scaled, it is aimed at an investigation application. For example, Jpn. Pat. Appln. KOKAI Publication No. 3-7571 discloses a nucleic acid detection device which amplifies and detects the nucleic acid and which can handle automatic processing.

Important problems in the development of the fully automatic nucleic acid analysis device are the mixture of the nucleic acid molecule which is not the object of the detection from the outside and leaking of the nucleic acid sample to the outside.

BRIEF SUMMARY OF THE INVENTION

A nucleic acid detection cassette according to an aspect of the present invention includes a cassette body, a nucleic acid detection region disposed in the cassette body, a first channel disposed in the cassette body, a second channel disposed in the cassette body. The nucleic acid detection region, in which a nucleic acid probe is immobilized, has a reagent inflow port, to which the first channel is connected, and a reagent outflow port, to which the second channel is connected. The nucleic acid detection cassette further includes a reagent injection portion which injects a reagent into the first channel, and a nucleic acid pretreatment region which is disposed in the first channel and which performs pretreatment for the detection of a nucleic acid. The first channel, the second channel, the nucleic acid detection region, the nucleic acid pretreatment region, and the reagent injection portion are sealed.

According to another aspect of the present invention, a nucleic acid detection device which makes use of the nucleic acid detection cassette is provided. The nucleic acid detection device includes a pump which moves a fluid including the reagent and which is connected to the first channel and the second channel to form a circulation channel.

According to the present invention, it is possible to prevent mixture of a nucleic acid molecule which is not an object of detection from the outside and prevent leaking of a nucleic acid sample to the outside.

DETAILED DESCRIPTION OF THE INVENTION

Embodiments will be described hereinafter with reference to the drawings.

First Embodiment

Figure 1:
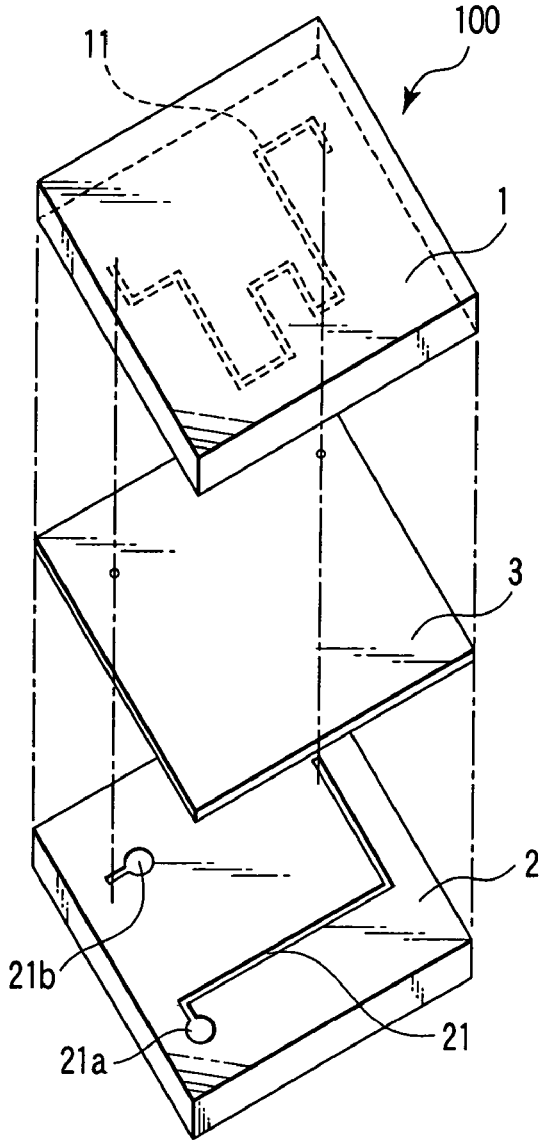
FIG. 1 is an exploded perspective view schematically showing the whole constitution of a nucleic acid detection cassette in a first embodiment of the present invention.
Figure 2:
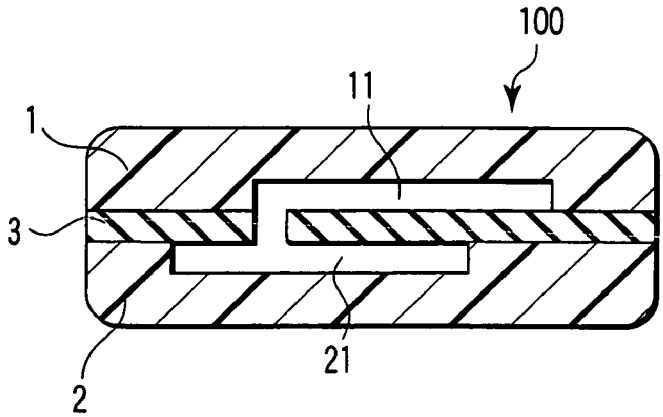
FIG. 2 is a conceptual diagram of a section of the nucleic acid detection cassette in the first embodiment.

FIG. 1 is a schematic perspective view of a nucleic acid detection cassette 100 in a first embodiment of the present invention. FIG. 2 is a conceptual diagram of a section of the nucleic acid detection cassette 100 of FIG. 1.

The nucleic acid detection cassette 100 includes a cassette upper body 1, an elastic sheet 3, and a cassette lower body 2. The elastic sheet 3 is sandwiched between the cassette upper body 1 and the cassette lower body 2 to thereby form the nucleic acid detection cassette 100. At this time, the sheet is sandwiched with an appropriate pressure to thereby keep sealability in the nucleic acid detection cassette 100. The cassette upper body 1 has a channel 11 on its inner surface, that is, the surface of the body which is brought into contact with the elastic sheet 3. The cassette lower body 2 has a groove 21 on its inner surface, that is, the surface of the body which is brought into contact with the elastic sheet 3. The channel 11 is connected to the groove 21 through a hole formed in the elastic sheet 3. The elastic sheet 3 may be provided with a groove forming a channel. A shape of the groove 21 is not especially limited, but examples of the shape of a section of the groove include a square shape, a rectangular shape, a semicircular shape, and a shape obtained by combining these shapes. Examples of a material of the cassette upper body 1 and the cassette lower body 2 include resins such as polyethylene, polypropylene, polystyrene, and polycarbonate, but the material is not especially limited to them. Examples of a material of the elastic sheet 3 include a resin such as silicon rubber, but the material is not especially limited to the example.

Figure 3:
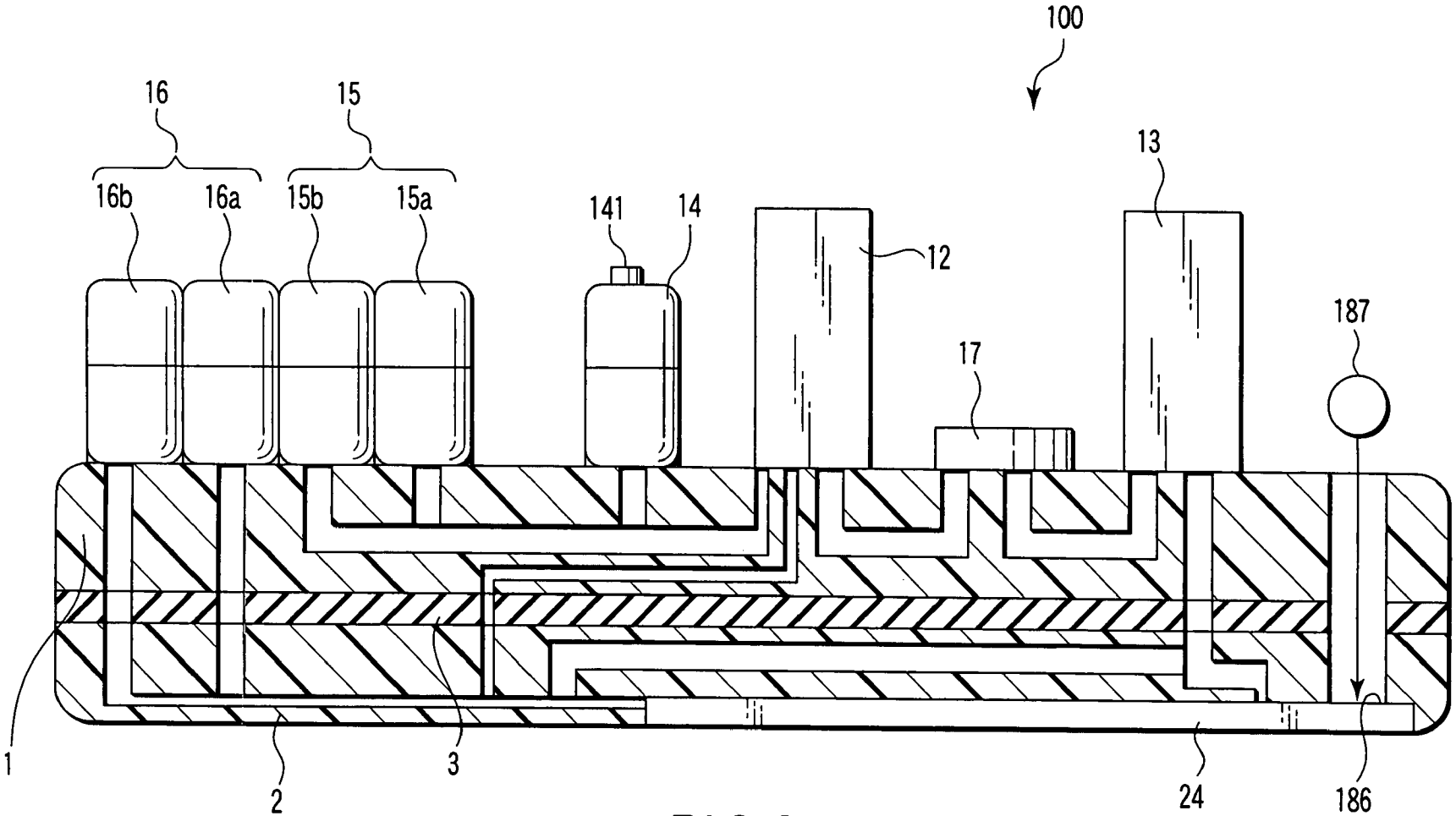
FIG. 3 is a diagram showing details of the section of the nucleic acid detection cassette in the first embodiment.

The cassette lower body 2 includes a waste liquid chamber 21*a* and a sample chamber 21*b*. The waste liquid chamber 21*a* is connected to the groove 21. In the example of FIG. 1, the reagent contained in the sample chamber 21*b* flows into the cassette upper body 1 through the hole of the elastic sheet 3. Moreover, the reagent passes through the channel 11 of the cassette upper body 1, and passes through the hole of the elastic sheet 3 again to return to the cassette lower body 2. The reagent passes through the groove 21 to enter the waste liquid chamber 21*a*. The flow of the reagent is disposed in this manner in two upper and lower stages of the channel 11 and the groove 21, and channels are efficiency arranged in a space. It is to be noted that FIGS. 1 and 2 show an example in which the chambers 21*a* and 21*b* are disposed in the cassette lower body 2. In FIG. 3 and the subsequent drawings, it is shown that a constitution corresponding to the chambers 21*a* and 21*b* is attached as a cartridge to the cassette upper body 1.

FIG. 3 shows details of a section of the nucleic acid detection cassette 100 in the first embodiment of the present invention. A part of elements such channels and valves is omitted from the drawing. The nucleic acid detection cassette 100 includes modules such as a nucleic acid pretreatment region in which a nucleic acid is extracted or amplified, a region to store a reagent, and a pump 17 on the outer surface of the cassette upper body 1, that is, the surface of the body which is not brought into the elastic sheet 3. Specifically, the nucleic acid detection cassette 100 includes a sample chamber 12, a waste liquid chamber 13, a nucleic acid extraction cartridge 14, a nucleic acid amplification cartridge 15, a nucleic acid detection cartridge 16, and a pump 17. These modules 12 to 17 are connected to one another by the channel 11 and the groove 21 to pass a fluid therethrough. The nucleic acid extraction cartridge 14, the nucleic acid amplification cartridge 15, and the nucleic acid detection cartridge 16 contain reagents for extraction, amplification, and detection, respectively. The sample chamber 12 contains a sample and the reagent. The waste liquid chamber 13 contains an unnecessary fluid. The nucleic acid amplification cartridge 15 includes two cartridges 15*a* and 15*b*. The nucleic acid detection cartridge 16 includes two cartridges 16*a* and 16*b*.

A detecting section 24 for performing the hybridization reaction or detecting the nucleic acid is disposed on the outer surface of the cassette lower body 2, that is, the surface of the body which is not brought into contact with the elastic sheet 3. The detecting section 24 has a signal interface 186 such as an electrode, and an electric connector 187 is brought into contact with the interface from the side of the cassette upper body 1. Accordingly, an nucleic acid detection signal is detected from the detecting section 24 through the electric connector 187.

It is to be noted that the channel 11 of the cassette upper body 1 or the groove 21 of the cassette lower body 2 shown in FIG. 3 is merely an example. Needless to say, various changes are possible such as changing of the liquid feed system and changing of arrangement of modules such as various types of cartridges.

Figure 4:
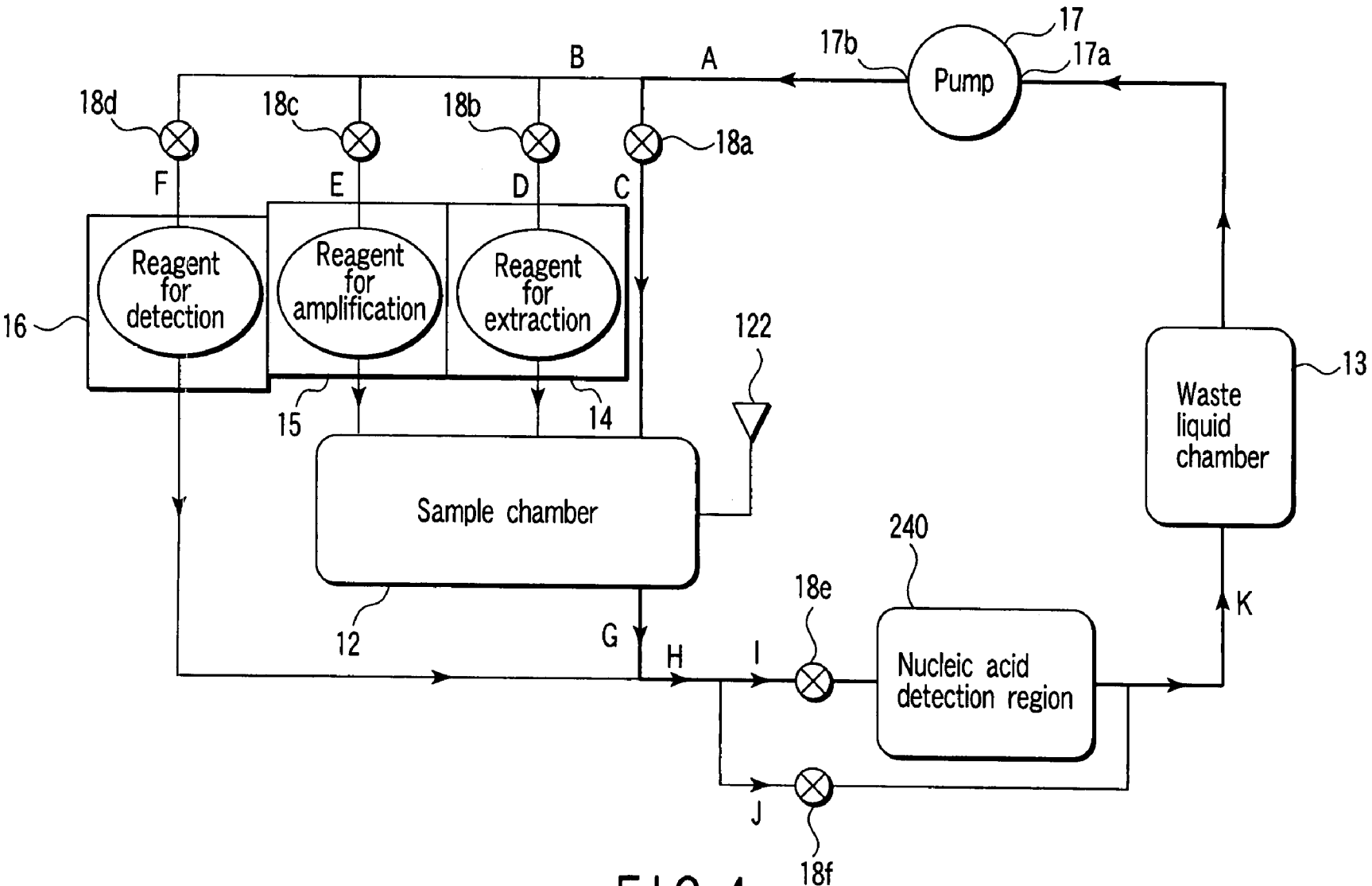
FIG. 4 is a diagram showing a constitution of a liquid feed system of the nucleic acid detection cassette shown in FIG. 3.

FIG. 4 shows a constitution of the liquid feed system of the nucleic acid detection cassette 100 shown in FIG. 3. The liquid feed system shown in FIG. 4 clearly shows a connecting relation among the modules shown in FIG. 3.

In FIG. 4, reference characters A to K show channels, and the channels are realized by the channel 11 and the groove 21 shown in FIGS. 1 to 3. The channels A, C, G, H, I, and K form a circulation channel. The pump 17 is disposed between the channels A and K. The channel A is connected to the channel C through a valve 18*a*, and the channels extend between the pump 17 and the sample chamber 12. The channel H is connected to the channel I through a valve 18*e*, and the channels extend between the sample chamber 12 and a nucleic acid detection region 240. The channel K extends between the nucleic acid detection region 240 and the pump 17. The nucleic acid detection region 240 includes a reagent inflow port and a reagent outflow port, the channel I is connected to the reagent inflow port, and the channel K is connected to the reagent outflow port. The channel K is provided with the waste liquid chamber 13. The channel J is branched from the channel H, and combined with the channel K. The channel J is provided with a valve 18*f*. The channel J is a bypass channel which allows the reagent, air or the like to bypass with respect to the nucleic acid detection region 240. The channel B is branched from the channel A, and connected to the channels D, E, and F through valves 18*b*, 18*c*, and 18*d*, respectively. Both of the channels D and E are connected to the sample chamber 12. The channel F is connected to the channel H. The nucleic acid extraction cartridge 14 is disposed in and connected to the channel D. The nucleic acid amplification cartridge 15 is disposed in and connected to the channel E. The nucleic acid detection cartridge 16 is disposed in and connected to the channel F.

The pump 17 has a pump suction port 17*a*, which is connected to the channel K, and a pump discharge port 17*b*, which is connected to the channel A. There is not any special restriction on the pump 17 as long as the pump needs to have a structure for keeping sealability. The pump 17 may comprise, for example, a piezoelectric pump which vibrates a film to feed a liquid (feed air) by use of a piezoelectric element, a tube pump which squeezes an elastic tube from the outside to feed the liquid (feed air), a syringe pump using a syringe or the like. In a case where the nucleic acid detection cassette 100 is disposable, as long as the sealability of the nucleic acid detection cassette 100 is kept, a pump function is preferably supplied from the outside, and the function is not disposed in the nucleic acid detection cassette 100 in order to reduce a cassette unit price.

Figure 5:
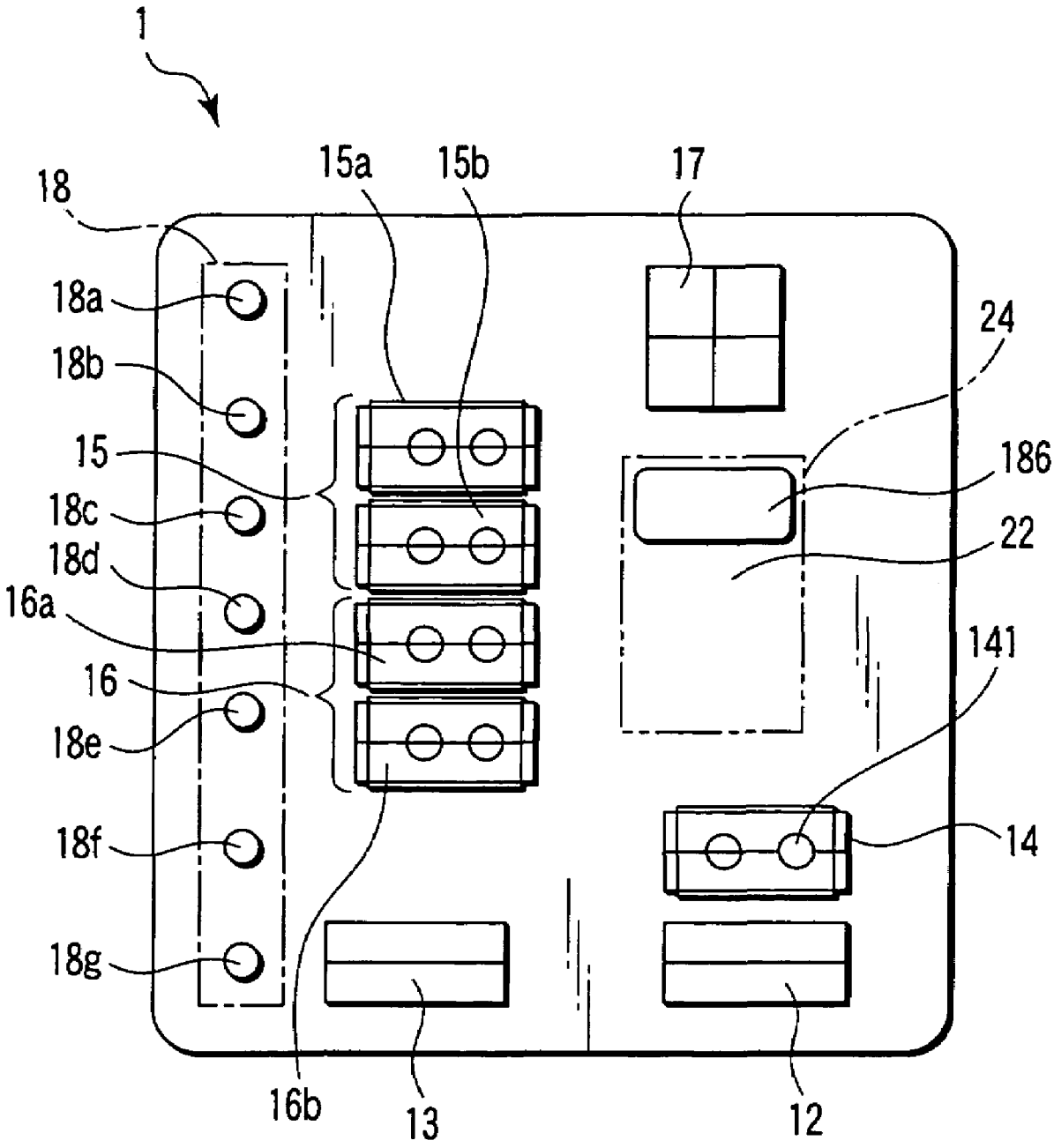
FIG. 5 is a top plan view of the nucleic acid detection cassette shown in FIG. 3.

FIG. 5 is a top plan view of the cassette upper body 1 shown in FIG. 3. As shown in FIG. 5, the sample chamber 12, the waste liquid chamber 13, the nucleic acid extraction cartridge 14, the nucleic acid amplification cartridge 15, the nucleic acid detection cartridge 16, the pump 17 and the like are disposed on the cassette upper body 1. The valves 18*a* to 18*g* are arranged in a valve region 18. The detecting section 24 is disposed on the cassette lower body 2, but shown for reference. A nucleic acid detection signal is extracted from the cassette upper body 1 through the signal interface 186.

The respective cartridges 14, 15*a*, 15*b*, 16*a*, and 16*b* which hold the reagent contain various types of reagents. Therefore, attention needs to be given to storage of the cartridges depending on properties. That is, in one embodiment, these cartridges 14, 15*a*, 15*b*, 16*a*, and 16*b* are preferably stored at a low temperature unlike the other part of the nucleic acid detection cassette 100. In another embodiment, the cartridges 14, 15*a*, 15*b*, 16*a*, and 16*b* are prepared separately from the cassette upper body 1 and the cassette lower body 2 by separate makers, and they may be assembled by a measuring person before measurement.

Figure 6:
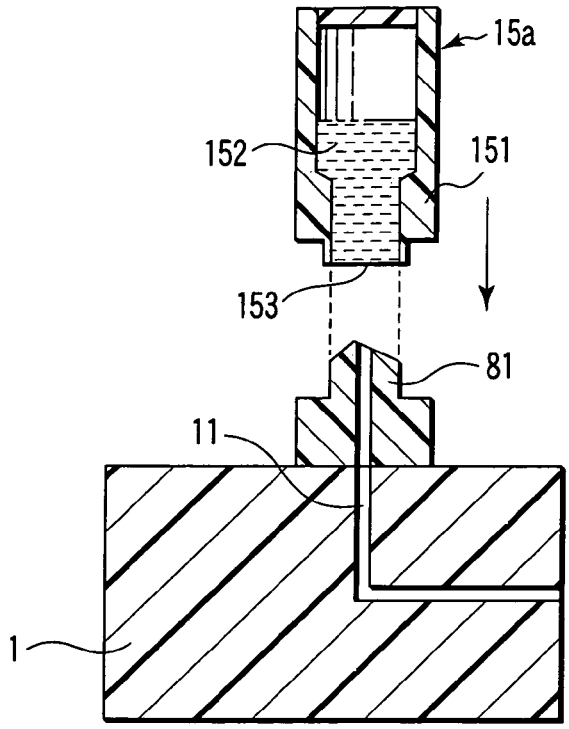
FIG. 6 is a diagram showing an embodiment of an interface between each cassette and a cassette upper body in the nucleic acid detection cassette of FIG. 3.

FIG. 6 shows one embodiment of an interface between the respective cartridges 14, 15*a*, 15*b*, 16*a*, and 16*b* in the nucleic acid detection cassette of FIG. 3 and the cassette upper body 1. FIG. 6 shows an example of the interface between the body and a nucleic acid amplification cartridge 15*a*. This also applies to another cartridge. As shown in FIG. 6, a container which contains a reagent 152 for amplification is constituted in a cartridge body 151, and a sealing film 153 is attached to an opening of a distant end of the body. In this state, the distant end of the cartridge body 151 is inserted into a protruding member 81 disposed on the outer surface of the cassette upper body 1. More specifically, the distant end of the protruding member 81 is inserted into the opening of the cartridge body 151. Accordingly, the nucleic acid amplification cartridge 15*a* is fitted in the cassette upper body 1.

Figure 7:
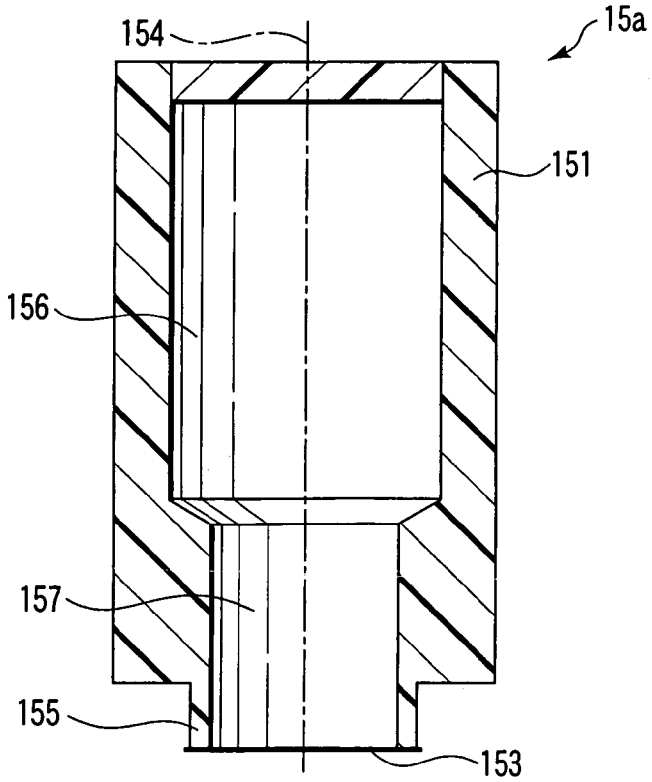
FIG. 7 is a diagram showing details of a section of a nucleic acid amplification cartridge shown in FIG. 6.
Figure 8:
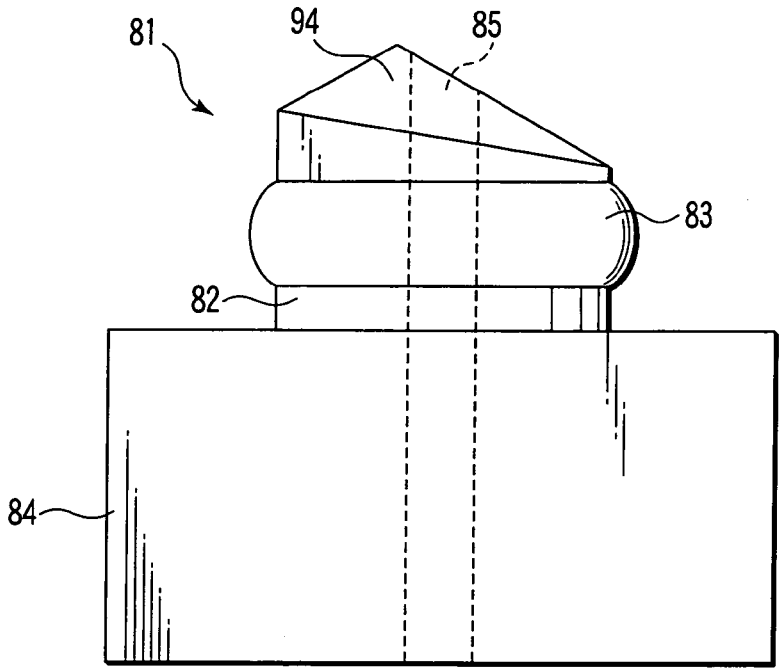
FIG. 8 is a diagram showing details of a protruding member shown in FIG. 6.

FIG. 7 shows details of a section of the nucleic acid amplification cartridge 15*a* shown in FIG. 6, and FIG. 8 shows details of the protruding member shown in FIG. 6. The distant end of the protruding member 81 is provided with a liquid channel 85 connected to the channel 11 in the cassette upper body 1, and the reagent 152 for amplification in the cartridge body 151 is introduced into the channel 11 of the cassette upper body 1 through the liquid channel 85.

As shown in FIG. 7, the cartridge body 151 forms a cylindrical shape centering on a central axis 154, and an outer diameter and an inner diameter increase or decrease along the axis. Both of the outer diameter and the inner diameter of the cartridge body 151 are constant from a bottom part of the body to a predetermined height, and an amplification reagent containing portion 156 is disposed in the body. The inner diameter of the amplification reagent containing portion 156 is slightly reduced in a distant end of the section, and the section is connected to a reagent introducing path 157. The outer diameter of a distant end 155 of the cartridge body 151 is set to be small, and the sealing film 153 is attached to the distant end when unused. The reagent for amplification contained in the amplification reagent containing portion 156 is sealed by this sealing film 153, and prevented from being brought into contact with outside air. There is not any restriction on a material of the cartridge body 151, but examples of the material include resins such as polyethylene, polypropylene, polystyrene, and polycarbonate. There is not any restriction on a material of the sealing film 153, but examples of the material include resins such as polyethylene, polypropylene, polystyrene, and polycarbonate, aluminum, and an aluminum evaporated resin.

As shown in FIG. 8, in the protruding member 81, a spherical seal member 83 is formed on a columnar support member 82 having a predetermined outer diameter. The spherical seal member includes a portion having an outer diameter which is slightly larger than that of the support member 82, and keeps a sealed state. Moreover, a saw tip 94 is further disposed on this spherical seal member 83. An outer diameter of the saw tip is smaller than that of at least the spherical seal member 83, and is preferably approximately equal to that of the support member 82. This saw tip 94 is formed with a gradient with respect to the surface of the cassette upper body 1. The sealing film 153 shown in FIG. 7 can be pressed onto the distant end of the saw tip to easily break the sealing film 153. The liquid channel 85 extends through the support member 82, the spherical seal member 83, and the saw tip 94 to communicate with the channel 11 in the cassette upper body 1. It is to be noted that there is not any special restriction on a shape of the saw tip 94, but examples of the shape include a shape obtained by cutting a plane, and a conical shape.

The nucleic acid amplification cartridge 15*a* containing the reagent 152 for amplification is pushed to the cassette upper body 1 so that a male side of a reagent interface, that is, the protruding member 81 of the cassette upper body 1, is inserted into a female side of the reagent interface, that is, the distant end 155 of the cartridge body 151, and thereby attached to the cassette upper body 1. In this state, the amplification reagent containing portion 156 is connected to the liquid channel 85 in a sealed state.

In another embodiment of the present invention, a part of the channel 11 formed in the cassette upper body 1 may be expanded. Accordingly, various types of cartridges and channels are built in the cassette upper body 1, and the body may be frozen and stored.

Figure 9:
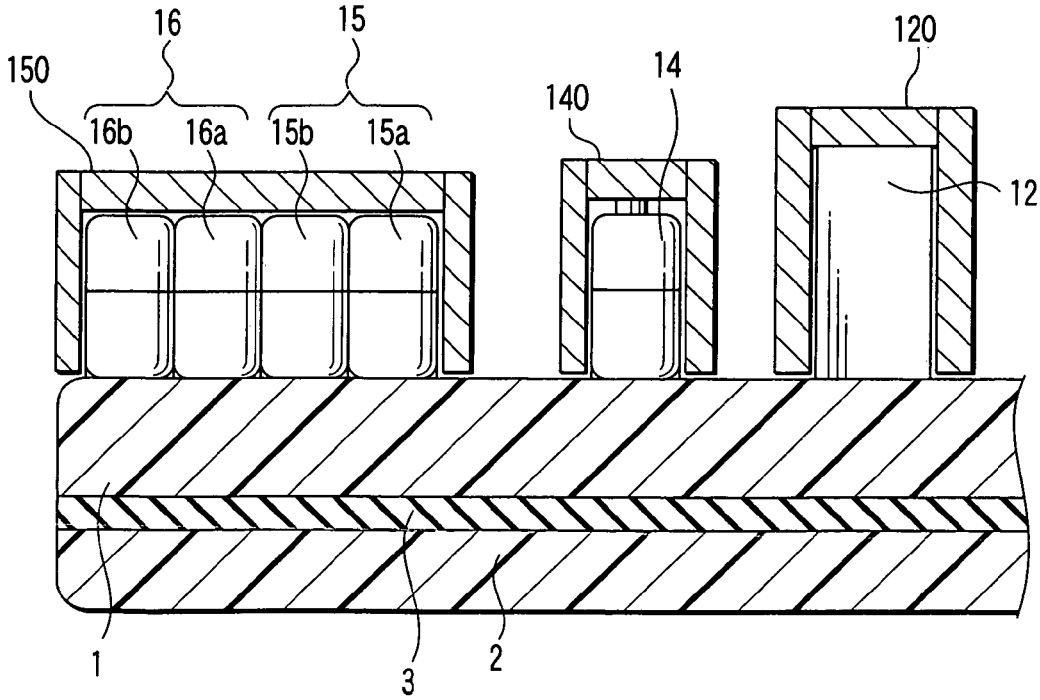
FIG. 9 is a diagram showing a method of temperature control by use of an aluminum block in the nucleic acid detection cassette of FIG. 3.

During reaction, as shown in FIG. 9, aluminum blocks 120, 140, 150 and the like whose temperatures are controlled are pressed onto the sample chamber 12, the nucleic acid extraction cartridge 14, the nucleic acid amplification cartridge 15, and the nucleic acid detection cartridge 16. Accordingly, the temperature of the reagent is controlled. It is to be noted that in FIG. 9, the aluminum blocks 120, 140, and 150 are slightly floated from the cassette upper body 1 in order to show that the blocks are separated before attached, but in actual, the blocks are brought into contact with the surface of the cassette upper body 1.

Figure 10:
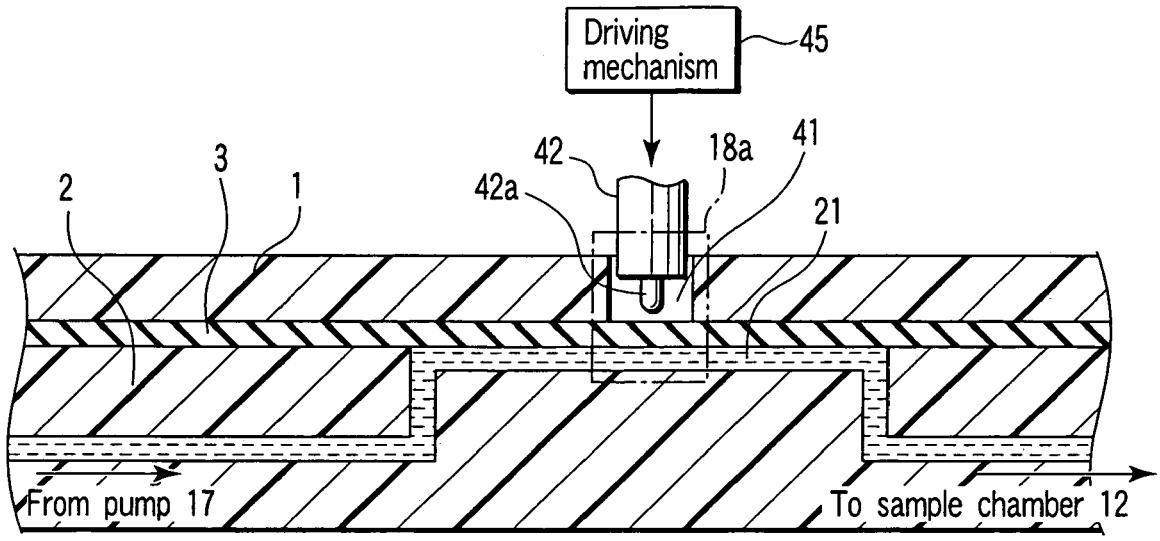
FIG. 10 is a sectional view showing the nucleic acid detection cassette around a valve shown in FIG. 5.
Figure 11:
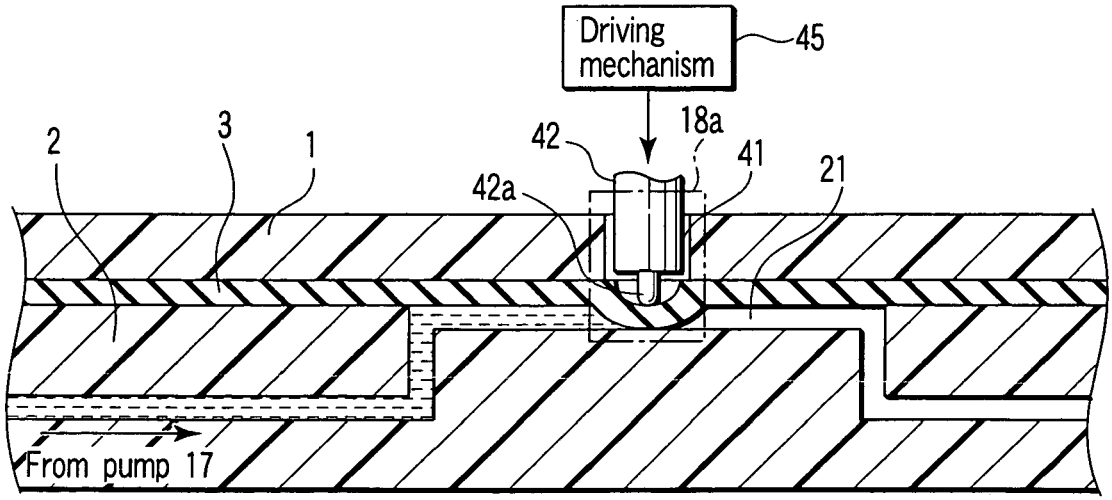
FIG. 11 is a sectional view showing the nucleic acid detection cassette around the valve shown in FIG. 5.

FIGS. 10 and 11 are sectional views of the nucleic acid detection cassette 100 around the valve 18*a*. FIG. 10 shows a state in which the valve 18*a* is opened, and FIG. 11 shows a state in which the valve 18*a* is closed. It is to be noted that in FIGS. 10 and 11, the valve 18*a* is shown as an example, but the other valves 18*b* to 18*g* have similar structures.

As shown in FIG. 10, a partial region of the cassette upper body 1 is provided with a valve opening and closing hole 41 which extends to the elastic sheet 3. Since the elastic sheet 3 exists under the cassette upper body 1, a bottom portion of the valve opening and closing hole 41 is constituted of the exposed elastic sheet 3. That is, the bottom portion of the valve opening and closing hole 41 is covered with the elastic sheet 3. This elastic sheet 3 and the groove 21 constitute a channel.

The valve 18*a* for opening and closing control of the channel is constituted by the valve opening and closing hole 41 extending through the cassette upper body 1 to communicate with the groove 21 and the elastic sheet 3 disposed between the valve opening and closing hole 41 and the groove 21. The valve 18*a* is driven by a driving mechanism 45 through a distant end 42*a* of a rod-shaped member 42 which is vertically movable. The rod-shaped member 42 may be provided on the cassette upper body 1 or the driving mechanism 45. The valve 18*a* can be held in at least two states. One of the states is a state in which the rod-shaped member 42 is held above as shown in FIG. 10. The other state is a state in which the rod-shaped member 42 is held below as shown in FIG. 11. In the state shown in FIG. 10, the distant end 42*a* of the rod-shaped member 42 is detached from the elastic sheet 3, and the groove 21 is not closed. This state corresponds to the opened state of the valve 18*a*. When the rod-shaped member 42 is moved downwards from the state shown in FIG. 10 by the driving mechanism 45, the distant end 42*a* of the rod-shaped member 42 pushes downwards the elastic sheet 3 in a direction substantially perpendicular to the surface of the sheet. As the distant end 42*a* of the rod-shaped member 42 moves downwards, the elastic sheet 3 is bent by the distant end 42*a* of the rod-shaped member 42, and a sectional area of the channel formed by the groove 21 is reduced. Moreover, when the distant end 42*a* of the rod-shaped member 42 is completely pressed downwards, the downward movement stops. This state corresponds to the closed state of the valve 18*a*. In this closed state, the groove 21 is completely closed, a flow of a fluid such as the reagent or air flowing from the pump 17 is stopped, and the fluid does not spread in the sample chamber 12.

When the depressed state of the elastic sheet 3 is controlled, opening and closing of the channel can be controlled, the channel being formed by the elastic sheet 3 and the cassette lower body 2.

Figure 12:
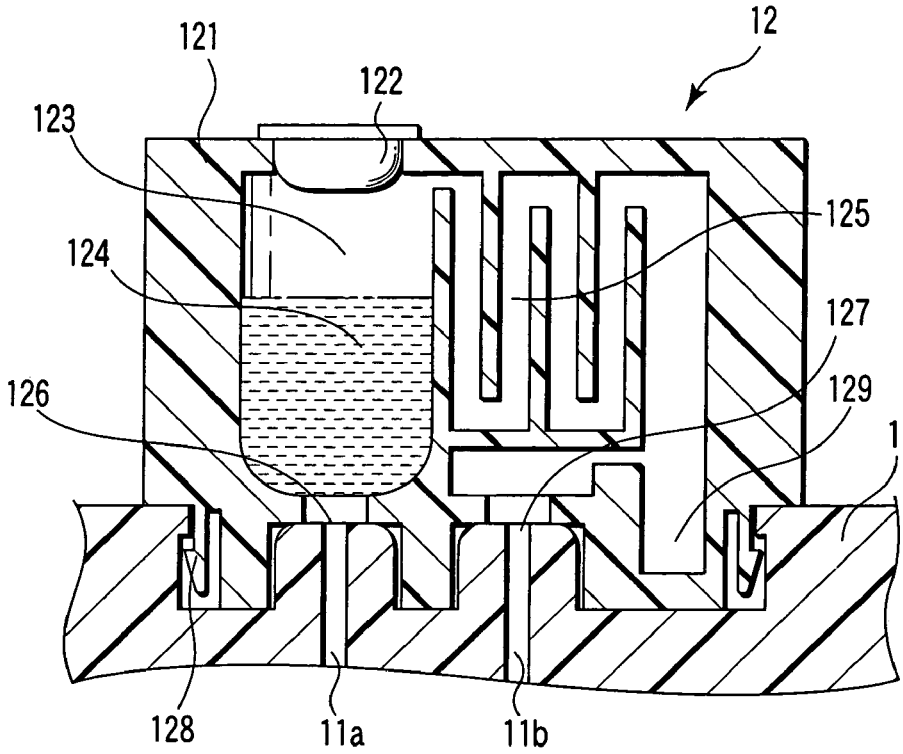
FIG. 12 is a diagram showing a detailed constitution of an example of a sample chamber in the nucleic acid detection cassette of FIG. 3.

FIG. 12 shows a detailed constitution of an example of the sample chamber 12. The sample chamber 12 can contain the reagent, and the chamber introduces a sample into the contained reagent to mix them. Therefore, the chamber has a function of not only introducing the reagent but also mixing the reagent and the sample.

As shown in FIG. 12, the sample chamber 12 includes a chamber body 121, a sample projection port 122, a reagent containing portion 123, a buffer pipe 125, an interface 126 for reagent, an interface 127 for air, and a stopper 128. Since a part of the chamber body 121 is attached to a recessed portion for the chamber in the cassette upper body 1, the body does not come off the stopper 128. In this attached state, the reagent containing portion 123 and a channel 11*a* are sealed and connected to each other in the interface 126 for reagent, and the buffer pipe 125 and a channel 11*b* are sealed and connected to each other in the interface 127 for air.

Figure 13:
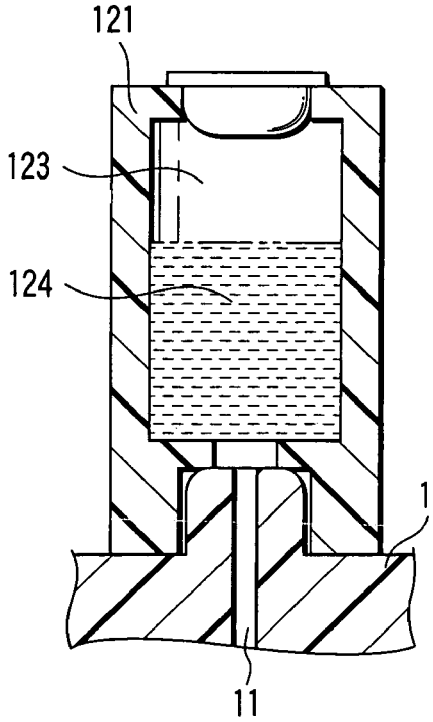
FIG. 13 is another sectional view of a sample chamber shown in FIG. 12.
Figure 14:
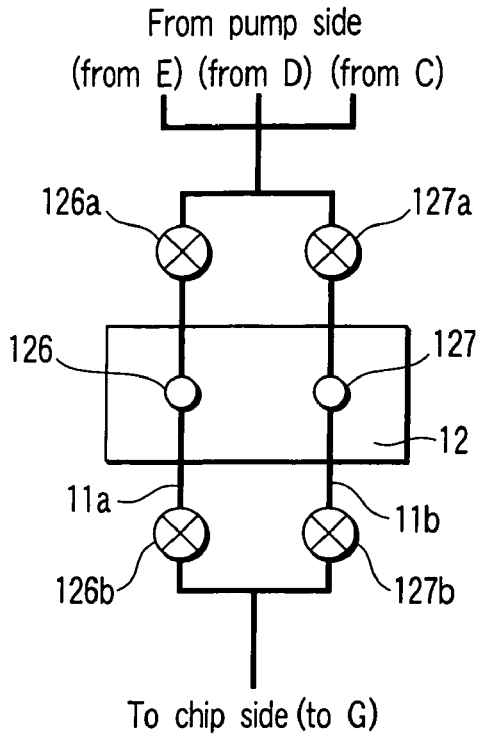
FIG. 14 is a diagram schematically showing a connecting relation between channels including an interface for a reagent and an interface for air in the sample chamber of FIG. 12.

FIG. 13 is another sectional view of the reagent containing portion 123 as viewed from a direction different from that of FIG. 12. FIG. 14 schematically shows a connecting relation between channels including the interface 126 for reagent and the interface 127 for air.

When the sample chamber 12 is attached, the reagent containing portion 123 is connected to the channel 11*a* disposed in the cassette upper body 1 by the interface 126 for reagent, and the buffer pipe 125 is connected to the other channel 11*b* by the interface 127 for air. The interface 126 for reagent and the interface 127 for air seal the chamber body 121 and the cassette upper body 1.

As shown in FIG. 14, the channel 11*a* connected to the interface 126 for reagent is branched into two directions, and one way of the channel 11*a* is connected to the channels C, D, and E shown in FIG. 4 through a valve 126*a*. The other way of the channel 11*a* is connected to the channel G shown in FIG. 4 through a valve 126*b*. The channel 11*b* connected to the interface 127 for air is branched into two directions, and one way of the channel 11*b* is connected to the channels C, D, and E shown in FIG. 4 through a valve 127*a*. The other way of the channel 11*b* is connected to the channel G shown in FIG. 4 through a valve 127*b*.

When the valves 126*a*, 126*b*, 127*a*, and 127*b*, the interface 127 for air is connected to a pump 17 side, and the interface 126 for reagent is connected to a nucleic acid detection region 240 side in a first state. In a second state, the connecting relation is reversed. In this manner, the connected channels can be changed.

For example, to introduce the reagent into the sample chamber 12, the interface 126 for reagent is connected to the pump 17 side, and the interface 127 for air is connected to the nucleic acid detection region 240 side. Furthermore, to feed the reagent from the sample chamber 12 to the nucleic acid detection region 240, the interface 126 for reagent is switched to the nucleic acid detection region 240 side, and the interface 127 for air is switched to the pump 17 side. Accordingly, the reagent is prevented from being passed through the interface 127 for air.

As shown in FIG. 12, the sample projection port 122 opens to the upper part of the reagent containing portion 123. One end of the buffer pipe 125 is connected to a side wall of the upper part of the reagent containing portion 123. This buffer pipe 125 constitutes an alternately folded labyrinth structure, and the other end of the pipe is connected to the interface 127 for air.

After the reagent is introduced from the sample projection port 122 into the reagent containing portion 123, the reagent is introduced from the interface 126 for reagent into the reagent containing portion 123 through the channel 11*a*. A certain amount of the reagent is supplied by the function of the pump 17. However, if the pump 17 continues to be operated even after supplying the certain amount of the reagent, air is supplied after the reagent. Since the reagent is supplied from the lower part of the reagent containing portion 123, and air is supplied after the reagent, the sample and the reagent are mixed. Since air is discharged as much as volumes of the supplied reagent and air from the interface 127 for air, a strict quantitative property is not required fro the pump 17. The sample chamber 12 includes the buffer pipe 125 having the labyrinth structure. Therefore, even when water droplets stick to the upper part of the sample chamber 12 owing to evaporation, splash or the like, a water content is not discharged out of the sample chamber 12. After mixing the sample with the reagent, various types of reactions are performed. The reacted sample is further mixed with another reagent if necessary. After repeating the reaction, the sample is introduced into another chamber or the nucleic acid detection region 240. At this time, conversely to a reagent supply time, the reagent is discharged from the interface 126 for reagent.

Figure 15:
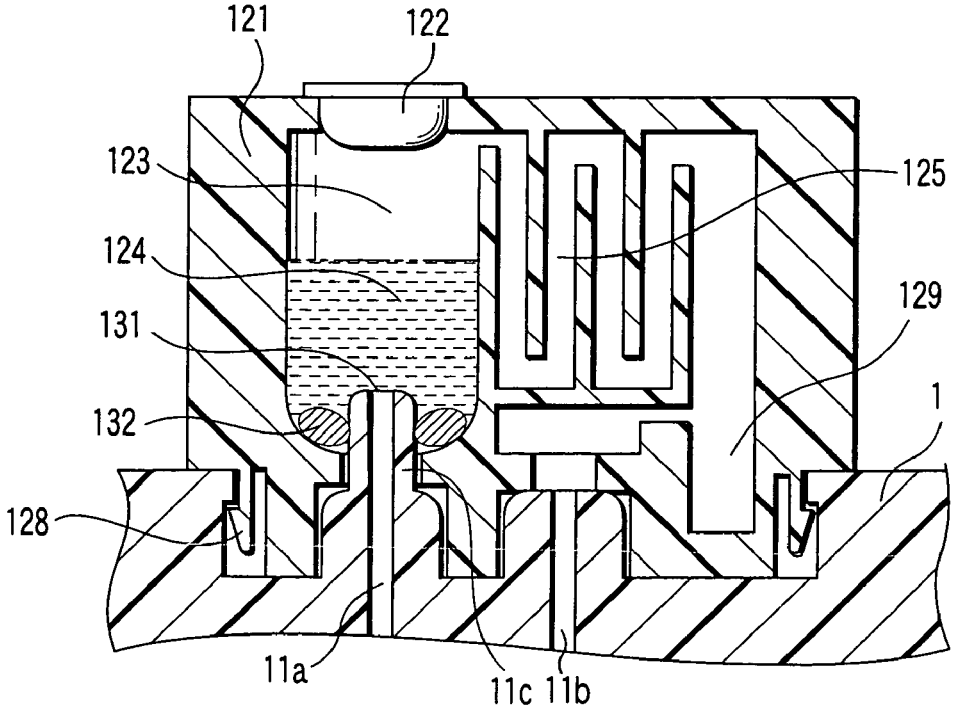
FIG. 15 is a diagram showing a modification of an interface constitution between the sample chamber and the cassette upper body shown in FIG. 12.

FIG. 15 shows a modification of an interface constitution between the sample chamber 12 and the cassette upper body 1. A reagent interface 131 shown in FIG. 15 is effective in a case where the sample includes a precipitate, and a supernatant liquid only is to be moved. As shown in FIG. 15, the cassette upper body 1 includes a protruding portion 11*c* formed to be higher above another surface. The bottom of the reagent containing portion 123 is provided with an opening corresponding to the protruding portion 11*c*. When the protruding portion 11*c* is fitted into the opening, the reagent interface 131 is disposed in a position higher than that of the bottom portion of the reagent containing portion 123. Accordingly, an only supernatant solution that does not include any reagent precipitate 132 is moved from the channel 11*a*. As the case may be, the reaction is sometimes inhibited, when impurities other than a nucleic acid molecule, for example, blood cells are mixed. Therefore, a filter may be disposed in an inflow port or an outflow port with respect to the channel 11*a* or 11*b*.

Figure 16:
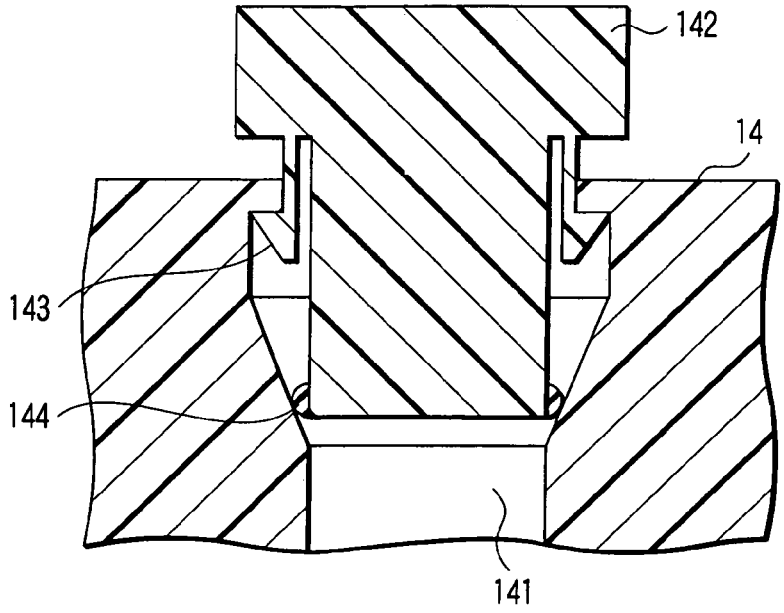
FIG. 16 is a diagram showing an example of a detailed constitution of a sample injection port of a nucleic acid extraction cartridge in the nucleic acid detection cartridge of FIG. 3.

FIG. 16 shows a detailed constitution of an example of a sample injection port 141 of the nucleic acid extraction cartridge 14. A bore diameter of the sample injection port 141 increases in a slightly deep position from the cartridge surface, and a sample injection port lid 142 is fitted into the corresponding position to contain the reagent airtightly in the cartridge. The sample injection port lid 142 is provided with a stopper 143 which prevents the sample injection port lid 142 from being removed by mistake and which accordingly prevents the reagent from being exposed to outside air. A sealing O-ring 144 is disposed in a peripheral edge portion of a distant end of the sample injection port lid 142, and this ring keeps sealed states of the sample injection port lid 142 and the nucleic acid extraction cartridge 14.

Figure 17:
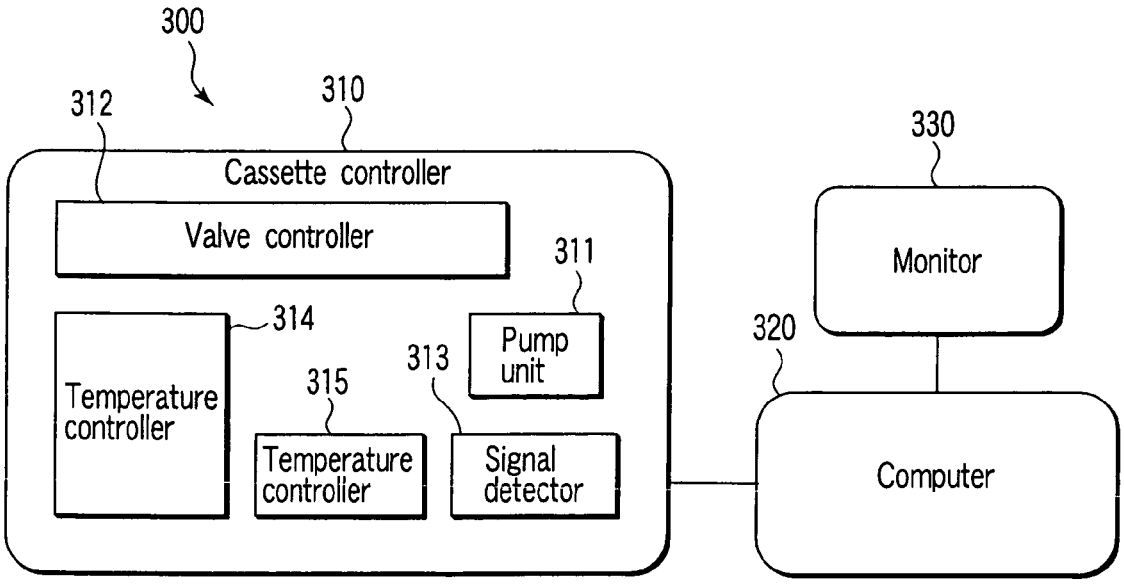
FIG. 17 schematically shows a nucleic acid detection device for use of the nucleic acid detection cassette in the first embodiment.

FIG. 17 schematically shows a nucleic acid detection device for making use of the nucleic acid detection cassette 100. As shown in FIG. 17, the nucleic acid detection device 300 includes a cassette controller 310 for controlling the nucleic acid detection cassette 100, a computer 320 for data analysis, and a monitor 330 for displaying analysis result. The cassette controller 310 includes a pump unit 311 for moving solution, a valve controller 312 for controlling valves 18*a* to 18*g* in the valve region 18, a signal detector 313 for detecting signals from the detecting section 24 through the signal interface 186, a temperature controller 314 for controlling temperature of the sample chamber 12, and a temperature controller 315 for controlling temperature of the nucleic acid extraction cartridge 14, nucleic acid amplification cartridge 15, and nucleic acid detection cartridge 16. In a case where the nucleic acid detection cassette 100 has no pump, the pump unit 311 includes a pump substituting for the pump 17, which has a pump suction port and a pump discharge port, which are sealed and connected to the channel K and the channel A, respectively. On the other hands, in a case where the nucleic acid detection cassette 100 has the pump 17, the pump unit 311 may include a pump driver for driving the pump 17.

Figure 18:
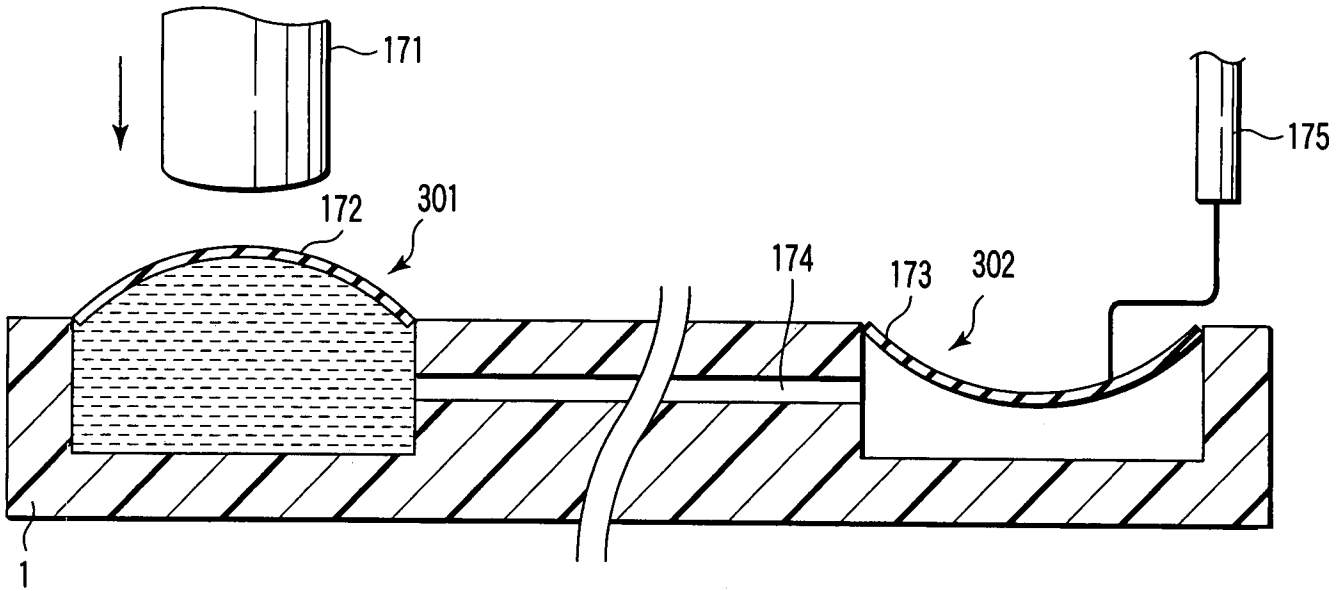
FIG. 18 is a diagram showing a modification of a chamber constitution shown in FIG. 3, in which a sample chamber is filled with solution.
Figure 19:
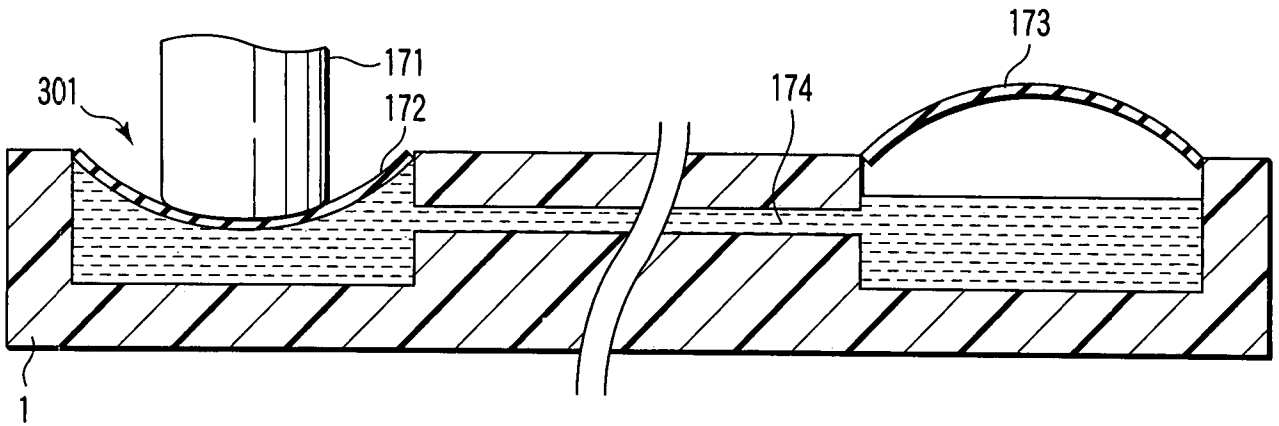
FIG. 19 is a diagram showing a modification of a chamber constitution shown in FIG. 3, in which the solution is partially moved into a waste liquid chamber.

FIGS. 18 and 19 show a modification of a chamber constitution. The constitution of the sample chamber 12 has been described with reference to, for example, FIGS. 12 and 15, but the constitution is not limited. The chamber may be constituted as shown in, for example, FIGS. 18 and 19. As shown in FIGS. 18 and 19, a sample chamber 301 includes a containing portion constituted of a recessed portion formed in the cassette upper body 1 and an elastic film 172 attached to the cassette upper body 1 to seal this containing portion. Similarly, a waste liquid chamber 302 includes a containing portion constituted of a recessed portion formed in the cassette upper body 1 and an elastic film 173 attached to the cassette upper body 1 to seal this containing portion. The containing portion of the sample chamber 301 is connected to that of the waste liquid chamber 302 by a channel 174 formed in the cassette upper body 1. These elastic films 172 and 173 are made of a material such as polyvinyl, polyethylene, polystyrene, polypropylene, polycarbonate, or silicon rubber. As shown in FIG. 18, in a case where the sample chamber 301 is filled with the reagent, when the reagent is moved to the waste liquid chamber 302, the elastic film 172 is pushed by a pressurizing movable unit 171. Accordingly, the elastic film 172 is bent to reduce a volume of the sample chamber 301, the reagent flows into the waste liquid chamber 302 through the channel 174, and the state shifts to that shown in FIG. 19. Alternatively, instead of the pressurizing by the pressurizing movable unit 171, as shown in FIG. 18, the reagent may be moved from the sample chamber 301 to the waste liquid chamber 302 by a pressure reducing operation by a pressure-reducing movable unit 175, that is, an operation to draw the elastic film 173. The reagent may be moved using both of the pressurizing movable unit 171 and the pressure-reducing movable unit 175, or may be moved using one of them.

Figure 20:
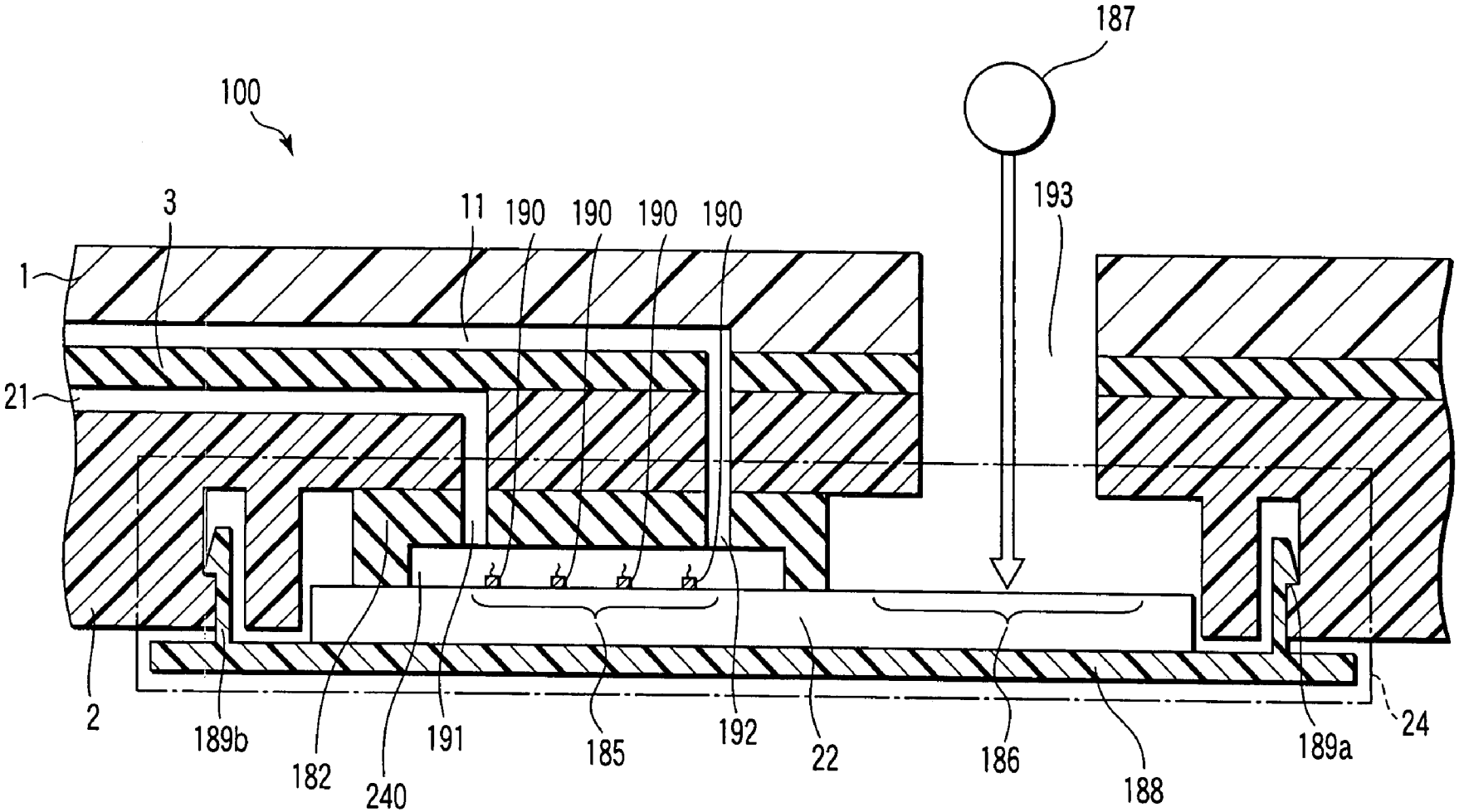
FIG. 20 is a sectional view of details of a detecting section shown in FIG. 3.

FIG. 20 is a detailed sectional view of the detecting section 24. As shown in FIG. 20, the detecting section 24 of the cassette lower body 2 is provided with a groove-shaped region disposed from the outer surface of the cassette lower body 2 to a predetermined depth. A nucleic acid probe immobilized chip 22 and a chip cover 188 are attached under pressure to this groove-shaped region through an elastic packing 182 by use of stoppers 189*a* and 189*b* so that the chip and the cover do not fall off. Therefore, when the nucleic acid probe immobilized chip 22 and the chip cover 188 are fitted under pressure, the sealed nucleic acid detection region 240 is formed between the surface of the nucleic acid probe immobilized chip 22 and the elastic packing 182, and the elastic packing 182 and the cassette lower body 2 are sealed. Accordingly, the cassette lower body 2 and the elastic packing 182 form a supply channel 191 and a discharge channel 192. The reagent flowing from the groove 21 flows from the supply channel 191 into the nucleic acid detection region 240. The reagent in the nucleic acid detection region 240 is sent from the discharge channel 192 toward the cassette upper body 1.

The nucleic acid probe immobilized chip 22 is obtained by immobilizing a nucleic acid probe on a substrate made of glass, silicon, or ceramic. In the present embodiment, a chip for detection by electrochemical measurement has been described as an example. In the chip, a terminal for applying a voltage or extracting an electric signal is disposed on a chip.

The nucleic acid probe immobilized chip 22 includes a plurality of electrodes 190 on the surface of the chip in a position facing the nucleic acid detection region 240. In the current detecting chip, the plurality of electrodes 190 function as, for example, a counter electrode, a working electrode, a reference electrode and the like. A nucleic acid probe complementary to a target nucleic acid is immobilized to the electrode 190 which functions as the working electrode among the electrodes. The nucleic acid detection region 240 may have any shape, but may be provided with a bent elongated channel, a cylindrical channel or the like by, for example, forming a groove to be provided with the elastic packing 182 into a bent elongated shape, a circular shape, or an elliptic shape.

Moreover, the nucleic acid detection cassette 100 is provided with an opening 193 which extends through the cassette upper body 1, the elastic sheet 3, and the cassette lower body 2 in a position different from a position corresponding to the nucleic acid detection region 240. The nucleic acid probe immobilized chip 22 includes the signal interface 186 electrically connected to a plurality of electrodes 190 in a position corresponding to the opening 193. The signal interface 186 includes, for example, a plurality of pads. When this signal interface 186 is brought into contact with the electric connector 187 through the opening 193, an electric signal from the electrode 190 can be extracted from the cassette upper body 1.

Figure 21:
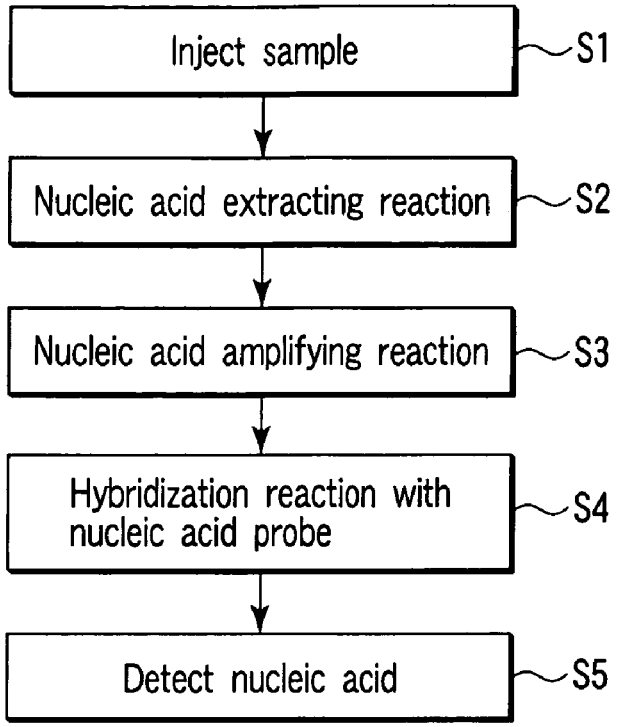
FIG. 21 is a flowchart of a nucleic acid detecting operation using the nucleic acid detection cassette in the first embodiment.

There will be described a nucleic acid detecting operation using the above-described nucleic acid detection cassette 100 with reference to a flowchart of FIG. 21.

First, a sample is injected through the sample injection port 141 shown in FIG. 3 into the nucleic acid extraction cartridge 14 in which the reagent is contained (S1). Moreover, this sample and the nucleic acid extracting reagent are mixed in the sample chamber 12, and a specimen nucleic acid is extracted from the sample (S2). Next, a nucleic acid amplifying reagent is injected into the sample chamber 12 which contains the reagent including the resultant specimen reagent, and a nucleic acid amplifying reaction is caused (S3). After performing such pretreatment for the detection of the nucleic acid, the nucleic acid amplified reagent, further a detecting reagent if necessary are sent into the nucleic acid detection region 240, and a hybridization reaction is caused with respect to the nucleic acid probe formed on the electrode 190 (S4). After the hybridization reaction ends, a buffer and an intercalator are introduced as another detecting reagent into the nucleic acid detection region 240, and an electric signal is acquired through the electric connector 187 (S5). Accordingly, the nucleic acid detecting operation is completed.

First, the step (S1) of injecting the sample will be described in detail.

To detect the nucleic acid, it is necessary to first take a sample including the nucleic acid and introduce the sample into the nucleic acid detection cassette 100. The method is various depending on a sample configuration, and some of the methods will be described.

In a case where the sample is blood, when the sample is taken beforehand, and stored in a blood sampling tube, an appropriate amount of the sample is introduced from the tube into the nucleic acid detection cassette 100. When the sample is allowed to permeate filtering paper, dried, and stored, the paper is cut into an appropriate size, and introduced into the nucleic acid detection cassette 100. After the introduction, the cassette is sealed with the sample injection port lid 142 which can achieve the sealing. In a case where blood is sampled on the spot, a blood sampling small needle is disposed directly on the nucleic acid detection cassette 100, and a needle portion can be pressed onto skin or the like to introduce the blood into the nucleic acid detection cassette 100. The nucleic acid detection cassette 100 achieves a sealed structure. Therefore, when a negative pressure is appropriately set in the structure beforehand, the blood can be sucked. Even under normal pressure, the blood can be introduced into the nucleic acid detection cassette 100 by use of a capillary phenomenon. In a case where the small needle is used, the needle portion is preferably provided with a rubber plug or a cover after the blood is sampled, so that the needle portion is prevented from being exposed to the outside. Even in a case where the sample is an oral mucosa, a method similar to that for the blood may be used. The sample may be animal hair, hair root, nail, or saliva, or plant. After the sample is introduced into the nucleic acid detection cassette 100, the cassette is closed with a lid which can achieve the sealing. When the lid is provided with a sample taking function, and a sample taking function section is plugged in the nucleic acid detection cassette 100, wastes can be reduced, and contaminations of another inspection by the taken sample can be more preferably reduced.

Next, steps will be described with reference to flowcharts of FIGS. 22 to 25.

Figure 22:
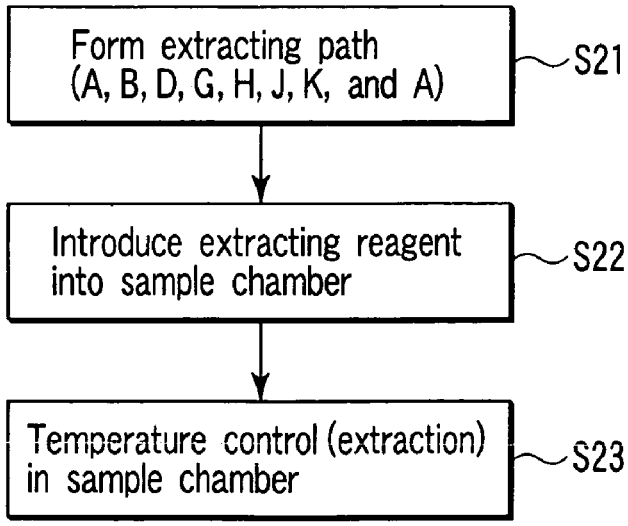
FIG. 22 is a flowchart of a nucleic acid extraction step in the first embodiment.

The nucleic acid extracting step (S2) is shown in detail in FIG. 22. As described above, after the sample is injected into the nucleic acid extraction cartridge 14, a circulation channel is formed by the channels A, B, D, G, H, J, K, and A (S21). The circulation channel is formed by opening the valves 18*b*, 18*f*, and closing the other valves 18*a*, 18*c*, 18*d*, and 18*e*. This valve opening and closing control is realized by a method shown in FIGS. 10 and 11. This also applies to the valve opening and closing control in another step described below. In a case where the circulation channel is formed, when the pump 17 is driven, a mixed solution of the injected sample and the nucleic acid extracting reagent is introduced from the nucleic acid extraction cartridge 14 into the sample chamber 12 (S22). At this time, as the case may be, the only supernatant solution of the nucleic acid extracting reagent is moved, or the solution may be moved through a filter. Moreover, in the sample chamber 12, the temperature is controlled using, for example, the aluminum blocks 120, 140, 150 and the like shown in FIG. 9, and a desired nucleic acid is extracted (S23). It is to be noted that in a case where there are a plurality of extracting reagents, and a plurality of nucleic acid extraction cartridges 14 are juxtaposed, the valves are controlled to open and close in order with respect to each nucleic acid extraction cartridge 14, and the circulation channel is successively formed. Accordingly, the respective extracting reagents are introduced into the sample chamber 12 in order.

It is to be noted that the nucleic acid extracting reagent may be introduced into the sample chamber 12 beforehand. Consequently, the step (S22) may be omitted.

Figure 23:
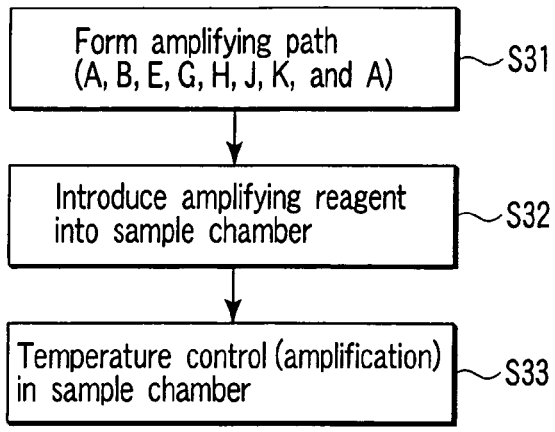
FIG. 23 is a flowchart of a nucleic acid amplification step in the first embodiment.

The nucleic acid amplifying step (S3) is shown in detail in FIG. 23. After the nucleic acid extracting step is completed, there are closed the valves disposed for the nucleic acid extraction in the circulation channel. Moreover, the circulation channel is formed by the channels A, B, E, G, H, J, K, and A (S31). The circulation channel is formed by opening the valves 18*c*, 18*f*, and closing the other valves 18*a*, 18*b*, 18*d*, and 18*e*. In a case where the circulation channel is formed, when the pump 17 is driven, a nucleic acid amplifying reagent is introduced from the nucleic acid amplification cartridge 15 into the sample chamber 12 (S32). The nucleic acid extracted reagent is already contained in the sample chamber 12, the reagents are mixed in the sample chamber 12, the temperature is controlled with a volume similar to that of (S23), and a desired amplified nucleic acid is obtained (S33). Alternatively, this is also possible by a heater built in the nucleic acid detection cassette 100. It is to be noted that in a case where there are a plurality of amplifying reagents, and a plurality of nucleic acid amplification cartridges 15 are arranged in parallel, the valves are controlled to open and close in order with the respective nucleic acid amplification cartridges 15, and the circulation channels are formed in order. Accordingly, the amplifying reagents are introduced into the sample chamber 12 in order.

Figure 24:
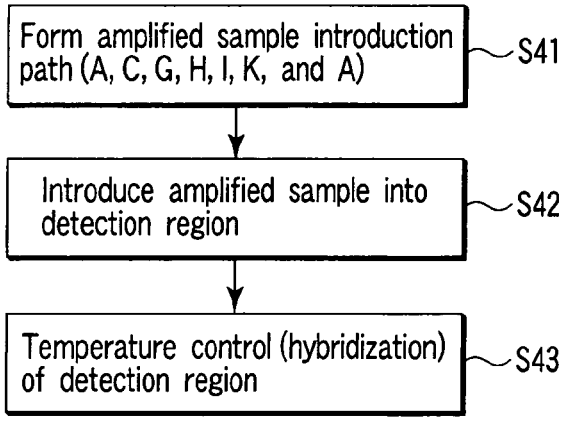
FIG. 24 is a flowchart of a hybridization reaction step in the first embodiment.

The hybridization reaction step (S4) is shown in detail in FIG. 24. After the nucleic acid amplifying step is completed, there are closed the valves disposed for the nucleic acid amplification in the circulation channel. Moreover, the circulation channel is formed by the channels A, C, G, H, I, K, and A for introducing the amplified nucleic acid into the nucleic acid detection region 240 (S41). The circulation channel is formed by opening the valves 18*a*, 18*e*, and closing the other valves 18*b*, 18*c*, 18*d*, and 18*f*. In a case where the circulation channel is formed, when the pump 17 is driven, the reagent including the amplified nucleic acid is sent from the sample chamber 12 into the nucleic acid detection region 240 (S42). Next, the temperature of the nucleic acid detection region 240 is controlled using, for example, a temperature adjustment mechanism (not shown), and the hybridization reaction is caused (S43). Accordingly, a target nucleic acid in the reagent including the amplified nucleic acid, and the nucleic acid probe is hybridized.

It is to be noted that after amplifying the nucleic acid, if necessary, a detecting reagent may be introduced into the sample chamber 12 containing the amplified nucleic acid, mixed, reacted, and introduced into the nucleic acid detection region 240 before the sample is introduced into the nucleic acid detection region 240. Specifically, the valves of the paths including the channels A, B, F, and G may be opened, and the other valves may be closed before (S41). In a case where the pump 17 does not have any quantitative property, a liquid detecting sensor may be disposed in an appropriate position of the reagent containing portion 123 of the sample chamber 12. Accordingly, an amount of a liquid to be fed can be controlled.

Figure 25:
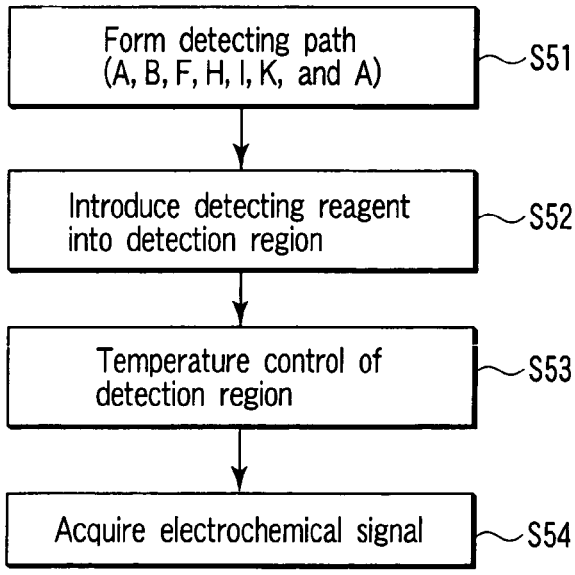
FIG. 25 is a flowchart of a nucleic acid detection step in the first embodiment.

The nucleic acid detecting step (S5) is shown in detail in FIG. 25. After the hybridization reaction is completed, there are closed the valves disposed for the hybridization reaction in the circulation channel. Moreover, the circulation channel is formed by the channels A, B, F, H, I, K, and A for introducing the detecting reagent into the nucleic acid detection region 240 (S51). This circulation channel is formed by opening the valves 18*d*, 18*e*, and closing the other valves 18*a*, 18*b*, 18*c*, and 18*f*. In a case where this circulation channel is formed, when the pump 17 is driven, the detecting reagent is introduced from the nucleic acid detection cartridge 16 into the nucleic acid detection region 240 (S52). It is to be noted that in a case where there are a plurality of detecting reagents, and a plurality of nucleic acid detection cartridges 16 are arranged in parallel, the valves are controlled to open and close in order with respect to the respective nucleic acid detection cartridges 16 to form the circulation channels in order. Accordingly, the respective detecting reagents are introduced in order into the nucleic acid detection region 240.

For example, a reagent for washing is introduced as the detecting reagent, and the temperature is controlled, whereby it is possible to desorb non-specifically bounded nucleic acid molecules in the nucleic acid detection region 240. Thereafter, another reagent required for the detection is introduced into the nucleic acid detection region 240. A fluorescent substance modifying reagent, an intercalator molecule, a mediator, a complex or the like may be introduced. If necessary, the reagents are reacted under the temperature control.

Next, the temperature of the nucleic acid detection region 240 is controlled using a temperature adjustment mechanism in the same manner as in the hybridization reaction step (S53), the electric connector 187 is brought into contact with the surface of the nucleic acid probe immobilized chip 22, and an electrochemical signal is acquired (S54). It is to be noted that as a detecting method, fluorescent detection, chemical emission detection or the like may be performed in addition to current detection.

As described above, the nucleic acid detection is completed. When the resultant electrochemical signal is analyzed using a known nucleic acid analysis method, it can be judged whether or not a specimen sample includes a target nucleic acid.

As described above, in the present embodiment, the nucleic acid detection cassette 100 includes the pump 17, the channels A to K, the sample chamber 12, the waste liquid chamber 13, the nucleic acid detection region 240, and the like, and the cassette has a completely sealed structure. Especially, the cassette has a circulation structure in which the channel K for discharging waste liquids from the nucleic acid detection region 240 is connected to the channel I for supplying the sample into the nucleic acid detection region 240 through the pump 17. As described above, the pump 17, the channels, the sample chamber 12, the nucleic acid detection region 240, the waste liquid chamber 13 and the like are integrated. In addition, this constitution is provided with the circulation structure. Accordingly, even when the substances (gas-solid-liquid) in the cassette are moved by reagent supply or chemical reaction, any substance is not exchanged from the outside. As a result, the amplified nucleic acid sample does not leak to the outside, and the nucleic acid molecule which is not the object of the detection can be prevented from being mixed into the nucleic acid detection cassette 100.

Moreover, the pump 17, the channels, the sample chamber 12, the nucleic acid detection region 240, the waste liquid chamber 13 and the like can be integrated in a state in which the completely sealed system is achieved. Therefore, any robot arm, conveyor or the like is not required, and the device can be easily miniaturized to such an extent that the device is usable at bed side or outdoors.

Furthermore, usually a part of the nucleic acid molecules in the sample to be detected includes the water content floating or sticking to the channel inner wall, and flows out of the channel K for the outflow from the nucleic acid detection region 240 in a stage before the sample is detected, and the molecules constitute non-detected molecules which do not contribute to detection. On the other hand, in the present embodiment, the nucleic acid detection cassette 100 has a circulation structure. Therefore, a part of the non-detected molecules are combined with the sample to be detected again before the sample is detected. Therefore, the number of the nucleic acid molecules contributing to the detection increases as compared with the cassette which does not have the circulation structure, and a detection sensitivity is improved.

As described above, since the constitution of the nucleic acid detection cassette 100 is provided with the circulation structure, all of liquid feeding steps in the nucleic acid detection can be performed while achieving the completely sealed system.

Second Embodiment

The present embodiment relates to a modification of the first embodiment. The present embodiment is different from the first embodiment of FIG. 3 in that a reaction region is disposed for each of steps of extracting a nucleic acid, amplifying the nucleic acid, and modifying the nucleic acid.

It is to be noted that redundant detailed description is omitted with respect to a part common to that of the first embodiment in FIGS. 1 to 25, and different respects will be described.

Figure 26:
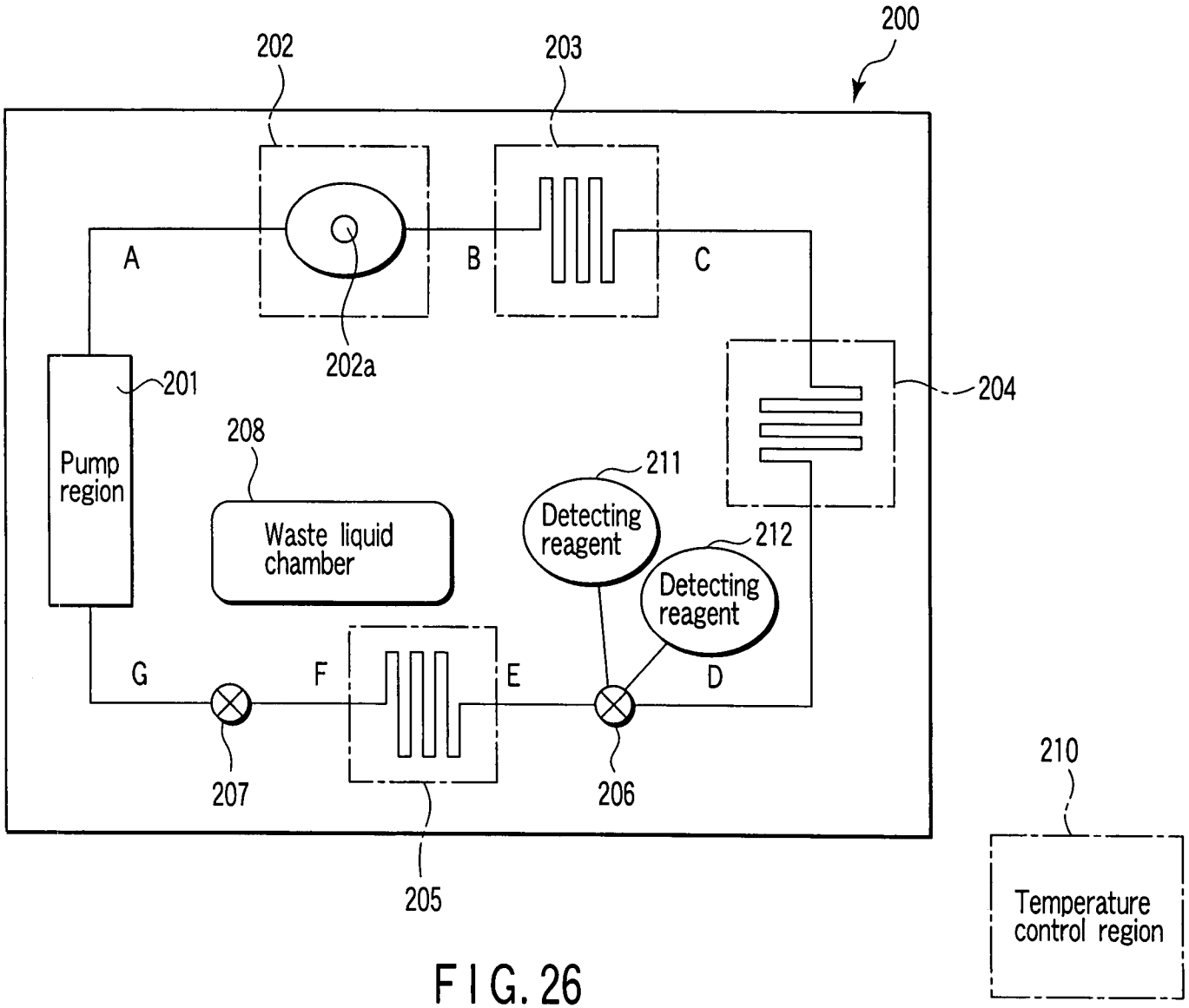
FIG. 26 is a diagram showing one example of a constitution of the nucleic acid detection cassette in a second embodiment of the present invention.

FIG. 26 is a diagram showing an example of a constitution of a nucleic acid detection cassette 200 of the present embodiment. As shown in FIG. 26, the nucleic acid detection cassette 200 includes a pump region 201, a nucleic acid extraction region 202, a nucleic acid amplification region 203, a nucleic acid modification region 204, a nucleic acid detection region 205, and a circulation channel constituted of channels A, B, C, D, E, F, and G which connect the regions to one another. The nucleic acid extraction region 202, the nucleic acid amplification region 203, the nucleic acid modification region 204, and the nucleic acid detection region 205 are arranged in order in the circulation channel along a step of extracting a nucleic acid to a step of detecting the nucleic acid.

The pump region 201 is disposed between the channels A and G. The nucleic acid extraction region 202 is disposed between the channels A and B. The nucleic acid amplification region 203 is disposed between the channels B and C. The nucleic acid modification region 204 is disposed between the channels C and D. A valve 206 is disposed between the channels D and E. This valve 206 is connected to detecting reagent chambers 211, 212 for introducing a detecting reagent. The nucleic acid detection region 205 is disposed between the channels E and F. A valve 207 is disposed between the channels F and G. The nucleic acid extraction region 202 is provided with a reaction chamber extended from an elongated channel constituted of the channels A to G. The nucleic acid extraction region 202 is provided with a sample injection port 202*a*, and a specimen sample can be injected through this port. Each of the nucleic acid amplification region 203, the nucleic acid modification region 204, and the nucleic acid detection region 205 is provided with a reaction chamber having a shape of an elongated meandering channel. Although not clearly shown in FIG. 26, a waste liquid chamber 208 is connected to a downstream side of the respective reaction regions 202, 203, 204, and 205. The valves leading to this waste liquid chamber 208 are controlled to open and close in the same manner as in a method of FIG. 10 or 11, so that the reagent which has reacted and has become unnecessary can be introduced into this waste liquid chamber 208.

Each of the nucleic acid extraction region 202, the nucleic acid amplification region 203, the nucleic acid modification region 204, and the nucleic acid detection region 205 has a constitution in which a relative positional relation with respect to a temperature control region 210 can be adjusted to control temperatures individually.

Moreover, although not especially clearly shown in FIG. 26, valves are disposed between the respective reaction regions 202, 203, 204, and 205. When the valves are successively opened along reaction steps, a reacted reagent can be introduced into the next reaction region from the reaction region 202 to 203, from 203 to 204, or from 204 to 205. In this case, each of the reaction regions 202, 203, 204, and 205 is preferably provided with a bypass channel which is switchable by control of opening/closing of each valve depending on specifications of a pump for use in the pump region 201. Therefore, any reagent is not introduced into a region other than the reaction region where a desired reaction is caused, and the pump effectively operates along a circulation path including the bypass channel.

In the nucleic acid detection cassette 200 of the present embodiment, the sample moves from the nucleic acid extraction region 202 to the nucleic acid amplification region 203, the nucleic acid modification region 204, and the nucleic acid detection region 205 while performing each reaction. Various types of reagents stock to a channel wall portion of each reaction region, and the sample flowing into the reaction region is mixed. For example, in a state in which the valve (not shown) on the downstream side of the nucleic acid extraction region 202 is closed, the sample introduced from the sample injection port 202*a* is mixed with the nucleic acid extracting reagent in the nucleic acid extraction region 202. The mixed and extracted nucleic acid reagent is introduced into the nucleic acid amplification region 203, when the valve on the downstream side of the nucleic acid extraction region 202 is opened in a state in which the valve (not shown) on the downstream side of the nucleic acid amplification region 203 is closed. Accordingly, the extracted nucleic acid reagent is mixed with the nucleic acid amplifying reagent sticking into the nucleic acid amplification region 203 to obtain an amplified nucleic acid. The reagent containing the resultant amplified nucleic acid is introduced into the nucleic acid modification region 204 in a similar method, and mixed with an already sticking nucleic acid modifying reagent to obtain a modified nucleic acid. The reagent containing the resultant modified nucleic acid is introduced into the nucleic acid detection region 205 by a similar method, and hybridization reaction is caused with respect to an already immobilized nucleic acid probe. After the hybridization reaction, the detecting reagent is introduced from the detecting reagent chambers 211, 212 into the nucleic acid detection region 205. After the introduction, an electric signal is acquired electrically from an electrode 190 in the nucleic acid detection region 205. Consequently, a nucleic acid detecting operation is completed.

The detecting reagent chambers 211, 212 and the waste liquid chamber 208 are made of a flexible material. When a pressure is applied to the detecting reagent chamber 211 from the outside, the detecting reagent is pushed out, and a sample filled in the nucleic acid detection region 240 moves to the waste liquid chamber 208. The reagent is moved between this detecting reagent chamber 211 and the waste liquid chamber 208 by a method similar to that of FIGS. 18 and 19 in the first embodiment.

It is to be noted that the waste liquid chamber 208 stores a waste liquid from the nucleic acid detection region 240, but may be replaced with the detecting reagent chamber 211, 212 or the like from which the reagent has been already moved. Therefore, the waste liquid chamber does not have to be disposed.

As described above, according to the present embodiment, the nucleic acid detection cassette 200 has a circulation structure in the same manner as in the first embodiment. Accordingly, a sealed structure is realized in which any reagent substance does not have to be exchanged from the outside. Therefore, the nucleic acid molecule which is not an object of the detection from the outside is prevented from being mixed, and the nucleic acid sample is prevented from being leaked to the outside. There is produced a function/effect similar to that of the first embodiment in which the cassette can be easily applied to miniaturization, and a detection sensitivity is improved.

It is to be noted that in the first and second embodiments, there has been described an example in which the cassette upper body 1 is provided with the modules or chambers for nucleic acid extraction, amplification, and detection, but the present invention is not limited to this example. For example, when the constitution of the channel is changed, various types of modules or chambers may be appropriately disposed in the cassette lower body 2 if necessary.

Moreover, there has been described a case where there are disposed one nucleic acid extraction cartridge 14, two nucleic acid amplification cartridges 15, and two nucleic acid detection cartridges 16, but the present invention is not limited to these numbers. More or less cartridges as compared with the embodiments may be arranged depending on a type of reagent required for each step, a size relation with respect to the cartridge or the like. In a case where a plurality of types of reagents, and cartridges, or a plurality of cartridges are arranged for one reaction step, the circulation channel in each reaction step is formed every cartridge.

Furthermore, the first and second embodiments relate to a nucleic acid detection device of an electrochemically detection system, but in a case where another system is used, various types of constitutions are appropriately changed if necessary depending on principle differences. For example, in the electrochemically detection system, there has been described a constitution in which the electric signal is extracted through the signal interface 186, but the constitution can be omitted in another system.

EXAMPLE

There will be described hereinafter a typical use example of the nucleic acid detection cassette 100 in the first embodiment.

1. Preparation of nucleic acid detection cassette 100

The following reagents were prepared for the respective reagent cartridges 14 to 16 of the nucleic acid detection cassette 100. In this example, there will be described a case where three cartridges 16*a* to 16*c* are used as nucleic acid detection cartridges 16.

Nucleic acid extraction cartridge 14: AmpDirect manufactured by Shimazu Corp.

Nucleic acid amplification cartridge 15*a*: enzyme for PCR

Nucleic acid amplification cartridge 15*b*: primer, DNTP

Nucleic acid detection cartridge 16*a*: buffer for hybridization (20×SSC)

Nucleic acid detection cartridge 16*b*: buffer for washing (0.2×SSC)

Nucleic acid detection cartridge 16*c*: intercalator solution (Hoechst 33258)

As a nucleic acid probe immobilized chip 22, a chip was prepared by immobilizing a DNA probe having the following array on electrodes 190-1, 190-2:

electrode 190-1: ATGCTTTCCGTGGCA; and electrode 190-2: ATGCTTTGCGTGGCA.

2. Fully automatic nucleic acid detection is performed. The following temperature control, liquid feed control, and detection are all programmed by an external system.

Each of the reagent cartridges 14 to 16, and chambers 12, 13 is controlled at a temperature of 4° C., and a nucleic acid detection region 240 is controlled at 25° C.

Blood is sampled from a person, and 1 μL of total blood is sampled with a pipette. A lid of a sample injection port 141 of the nucleic acid cartridge 14 is opened, the total blood is injected, and the lid is closed.

A reagent is successively introduced from the reagent cartridges 15*a*, 15*b* into the reagent cartridge 14. Thereafter, the temperature of an aluminum block 140 brought into contact with the reagent cartridge 14 is controlled, and a PCR reaction is performed.

A PCR product is introduced into the sample chamber 12, a buffer for hybridization is introduced from the reagent cartridge 16*a* into the sample chamber 12, and a sample for detection is prepared.

The sample for detection is introduced into the nucleic acid detection region 240, and the temperature is controlled at 35° C. After one hour, the buffer for washing is introduced from the reagent cartridge 16*b* into the nucleic acid detection region 240. Moreover, the sample for detection is sent to a waste liquid chamber 13. The sample is retained for one hour while the temperature is controlled at 35° C.

The intercalator solution is introduced from the reagent cartridge 16*c* into the nucleic acid detection region 240. Moreover, the buffer for washing is sent to the waste liquid chamber 13. The temperature is controlled at 25° C., and the sample is retained for ten minutes.

A potential of the electrode is controlled from the external system, and a current signal of an intercalator molecule is measured.

It has been found that since a current value obtained from the electrode 190-1 is larger than that obtained from the electrode 190-2, the DNA in the taken sample has an array of CTG CCACGGAAAG CAT.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A nucleic acid detection cassette comprising:

a cassette body;

a nucleic acid detection region which is disposed in the cassette body and which has a reagent inflow port and a reagent outflow port and in which a nucleic acid probe is immobilized;

a first channel which is disposed in the cassette body and which is connected to the reagent inflow port of the nucleic acid detection region;

a second channel which is disposed in the cassette body and which is connected to the reagent outflow port of the nucleic acid detection region;

a reagent injection portion which injects a reagent into the first channel; and a nucleic acid pretreatment region which is disposed in the first channel and which performs pretreatment for the detection of a nucleic acid, the first channel, the second channel, the nucleic acid detection region, the nucleic acid pretreatment region, and the reagent injection portion being sealed, the first and second channels being connected to each other to form a circulation channel of the first channel, the second channel, the nucleic acid detection region, the nucleic acid pretreatment region, and the reagent injection portion.

2. The nucleic acid detection cassette according to claim 1, wherein the nucleic acid pretreatment region includes a region which performs a nucleic acid amplifying.

3. The nucleic acid detection cassette according to claim 2, wherein the nucleic acid pretreatment region further includes a region which performs a nucleic acid extracting.

4. The nucleic acid detection cassette according to claim 1, wherein the first channel and the second channel constitute part of a pump which moves a fluid including the reagent.

5. The nucleic acid detection cassette according to claim 1, further comprising a pump which moves a fluid including the reagent, wherein the first channel and the second channel are connected through the pump.

6. The nucleic acid detection cassette according to claim 1, further comprising a valve disposed in a channel including the first channel and the second channel.

7. The nucleic acid detection cassette according to claim 5, wherein the first channel includes two channels which branch and recombine in the nucleic acid pretreatment region, the nucleic acid pretreatment region includes a sample chamber which contains a solution, the sample chamber includes a reagent containing portion and a buffer pipe, the reagent containing portion has a lower end portion which is connected to one of the branched channels, and the buffer pipe has an end which is connected to an upper end portion of the reagent containing portion and another end which is connected to the other branched channel.

8. The nucleic acid detection cassette according to claim 5, further comprising a third channel disposed in the cassette body, branched from the first channel between the nucleic acid pretreatment region and the nucleic acid detection region, and combined with the second channel between the nucleic acid detection region and the pump; a valve disposed in the third channel; and a valve disposed in the first channel between a branching portion to the third channel and the nucleic acid detection region.

9. The nucleic acid detection cassette according to claim 5, further comprising a waste liquid chamber disposed in and connected to the second channel.

10. The nucleic acid detection cassette according to claim 5, wherein the nucleic acid pretreatment region includes a nucleic acid extraction region which performs a nucleic acid extracting and a nucleic acid amplification region which performs a nucleic acid amplifying, and the nucleic acid extraction region and the nucleic acid amplification region are disposed in order from the pump to the nucleic acid detection region in the first channel.

11. The nucleic acid detection cassette according to claim 10, wherein the nucleic acid pretreatment region further includes a nucleic acid modification region which performs a nucleic acid modifying, and the nucleic acid modification region is disposed in the first channel between the nucleic acid amplification region and the nucleic acid detection region.

12. The nucleic acid detection cassette according to claim 5, wherein the nucleic acid detection cassette further includes a valve disposed in a channel including the first channel and the second channel, further comprising a valve controller which controls the valve of the nucleic acid detection cassette.

13. The nucleic acid detection cassette according to claim 1, further comprising a region to store a detection reagent, which is introduced into the nucleic acid detection region.

* * * * *